US009416763B2

(12) United States Patent
Ikeda

(10) Patent No.: US 9,416,763 B2
(45) Date of Patent: Aug. 16, 2016

(54) AFTER-TREATMENT APPARATUS FOR EXHAUST GAS IN A COMBUSTION CHAMBER

(75) Inventor: Yuji Ikeda, Kobe (JP)

(73) Assignee: IMAGINEERING, INC., Hyogo (JP)

( * ) Notice: Subject to any disclaimer, the term of this patent is extended or adjusted under 35 U.S.C. 154(b) by 1085 days.

(21) Appl. No.: 12/881,869

(22) Filed: Sep. 14, 2010

(65) Prior Publication Data

US 2011/0023458 A1 Feb. 3, 2011

Related U.S. Application Data

(63) Continuation-in-part of application No. PCT/JP2009/054964, filed on Mar. 13, 2009.

(30) Foreign Application Priority Data

Mar. 14, 2008 (JP) ..... 2008-066888

(51) Int. Cl.
*F02P 13/00* (2006.01)
*F02P 23/04* (2006.01)
*F01N 3/08* (2006.01)

(52) U.S. Cl.
CPC ..... *F02P 23/045* (2013.01); *F01N 3/0892* (2013.01); *F01N 2240/28* (2013.01)

(58) Field of Classification Search
CPC ..... F01N 2240/28; F01N 3/0892; F01N 2240/38; F02P 23/045; F02P 13/00; F16J 15/064; F02M 27/04; F02M 27/042
USPC ..... 60/275; 123/143 R, 143 B, 151, 169 EL, 123/536, 606
See application file for complete search history.

(56) References Cited

U.S. PATENT DOCUMENTS 3,934,566 A * 1/1976 Ward ..... 123/275
4,499,872 A * 2/1985 Ward et al. ..... 123/344

(Continued)

FOREIGN PATENT DOCUMENTS

JP 7-012037 A 1/1995
JP 11-317277 A 11/1999
JP 2002-527666 A 8/2002
JP 2002-276333 A 9/2002

(Continued)

OTHER PUBLICATIONS

International Search Report of PCT/JP2009/054964, mailing date Jun. 9, 2009.

*Primary Examiner* — Audrey K Bradley
*Assistant Examiner* — Jonathan Matthias
(74) *Attorney, Agent, or Firm* — Westerman, Hattori, Daniels & Adrian, LLP

(57) ABSTRACT

An after-treatment apparatus for exhaust gas in a combustion chamber includes a discharge device with an electrode exposed to the combustion chamber and installed in at least one of members constituting the combustion chamber, an antenna installed in at least one of the members constituting the combustion chamber so as to radiate electromagnetic waves into the combustion chamber, an electromagnetic wave transmission line installed in at least one of the members constituting the combustion chamber and with one end connected to the antenna and the other end covered with an insulator or dielectric and extending to a portion, in at least one of the members constituting the combustion chamber, distant from the combustion chamber, and an electromagnetic wave generator for feeding electromagnetic waves to the electromagnetic wave transmission line. The after-treatment apparatus is configured such that discharge is generated with the electrode of the discharge device and the electromagnetic waves fed from the electromagnetic wave generator through the electromagnetic wave transmission line are radiated from the antenna, while the exhaust gas remains in the combustion chamber after the exhaust gas is produced during the explosion stroke.

1 Claim, 23 Drawing Sheets

(56) References Cited

U.S. PATENT DOCUMENTS

| | | | | |
|---|---|---|---|---|
| 6,467,467 | B1 * | 10/2002 | Massholder | 123/536 |
| 7,182,076 | B1 * | 2/2007 | Minker | 123/606 |
| 7,661,402 | B2 | 2/2010 | Minami | |
| 8,365,707 | B2 * | 2/2013 | Ikeda | 123/536 |
| 8,602,005 | B2 * | 12/2013 | Ikeda | 123/536 |
| 2005/0110222 | A1 * | 5/2005 | Matsumoto et al. | 277/592 |
| 2007/0209634 | A1 | 9/2007 | Minami | |
| 2011/0030660 | A1 * | 2/2011 | Ikeda | 123/536 |

FOREIGN PATENT DOCUMENTS

| | | | |
|---|---|---|---|
| JP | 2004-169643 | A | 6/2004 |
| JP | 2004-293522 | A | 10/2004 |
| JP | 2004-353596 | A | 12/2004 |
| JP | 2005-502823 | A | 1/2005 |
| JP | 2006-132483 | A | 5/2006 |
| JP | 2006-132518 | A | 5/2006 |
| JP | 2007-113570 | A | 5/2007 |
| JP | 2007-270824 | B1 | 10/2007 |

* cited by examiner

AFTER-TREATMENT APPARATUS FOR EXHAUST GAS IN A COMBUSTION CHAMBER

TECHNICAL FIELD

This invention belongs to the technical field of the internal combustion engine and relates to an after-treatment apparatus for exhaust gas in an internal combustion engine with an intake-exhaust system.

BACKGROUND OF THE INVENTION

The gas in an internal combustion engine contains gas state components, PM (Particulate Matter, can say Particulate), unburned hydrocarbons (UBS or HC), carbon monoxide (CO), nitric oxides ($NO_X$), carbon dioxide ($CO_2$), water vapor ($H_2O$), oxygen ($O_2$), and nitrogen ($N_2$) and so on. PM in exhaust gas from, for example diesel among internal combustion engines, points solid or liquid particles larger than 10 μm. The solid or liquid particles include soot consisting of carbonaceous, combustible organic fraction that consists high-boiling-point carbon hydride and sulfate moieties.

For example, Patent Document 1 discloses a discharge type exhaust gas control apparatus that includes a diesel particulate filter and a plasma generator as an exhaust gas control apparatus for eliminating these components from exhaust gas. The diesel particulate filter is installed in the exhaust passage. The plasma generator is combined with the diesel particulate filter or installed upstream of the filter. The plasma generator stably supplies $NO_2$ and active substances (active oxygen), which are needed for the combustion (oxidation) of exhaust particulates collected by the particulate filter, in the discharge-type exhaust gas control apparatus.

Patent Document 2 discloses an exhaust gas control apparatus comprising an after-treatment device which cleans aeration exhaust gas in the middle of exhaust pipe from an internal combustion engine. The exhaust gas control apparatus includes a plasma generator, flow-through oxidation catalyst, a means of adding fuel and increasing the temperature. The plasma generator generates plasma by discharging into the exhaust gas above the after-treatment device. The style oxidation catalyst is installed before the plasma generator. Fuel is added to the exhaust gas before the oxidation catalyst by the means of adding fuel. The means of increasing the temperature elevates temperature of exhaust gas until occurring oxidation, on the oxidation catalyst, of fuel added by the means of adding fuel. Using this apparatus to energize exhaust gas with the discharge of the plasma generator into the exhaust gas, the unburned carbon hydride is converted into active radicals, oxygen into ozone, NO into $NO_2$. These exhaust gas components becomes active, resulting in a greater exhaust purification effect than with existing after-treatment devices from low temperature area.

Patent Document 3 discloses an after-treatment method for exhaust gas and apparatus for it. In this apparatus, an after-treatment unit for exhaust gas, a particulate filter, is placed in the exhaust pipe and an oxidation reactor, a plasma reactor, is installed upstream from it. When the oxidation reactor generates non-heat plasma in the exhaust gas flowing through the oxidation reactor, oxidants are generated from the exhaust gas components. As the result, soot is incinerated with the oxidants in the particulate filter, and reproduced.

Patent Document 4 discloses an exhaust gas purification apparatus. It contains a filter that catches particulate matter, an absorbent that absorb components of the exhaust gas, and a plasma generator that generate plasma with applied voltage, in exhaust smoke path of the internal combustion engine. The exhaust gas purification apparatus eliminates the accumulated particles on the filter and absorbent material or the exhaust gas components at normal temperature below the particulate ignition temperature. It enables the removal of harmful substances and particulates contained in internal combustion engine gases, such as diesel exhaust gas, at exhaust temperatures below 150° C.

Patent Document 5 discloses an exhaust purification apparatus comprising a means of purification and a means of forming plasma. The purifier is installed in the exhaust path of the internal combustion engine, and contains NOx-absorbing materials and/or a particle filter. The means of forming plasma is installed in the exhaust path. The exhaust purification apparatus comprises a means of detecting oxygen density and controlling means. The means of detecting oxygen density detects oxygen density in exhaust gas. The controlling means results in the purification of the exhaust gas due to the means of purification when the oxygen density on the means of detecting oxygen density, decreasing the oxygen density in the exhaust gas while simultaneously driving the means of forming plasma when the amount of absorbed material exceeds a predetermined value. If applying this apparatus for stationary fuel system, such as steam generator and gas turbine, or transferring fuel system such as diesel automobile, the cost is lower than that of existing plasma processes because of un-necessity of firm power. Moreover it will be possible to remove NOx and soot at the same time effectively by plasma desorption at high density.

Patent Document 6 discloses a ways to reduce particle matter included in the exhaust gas from a lean-burn engine. In the ways to reduce particle matter, plasma is generated in the exhaust gas, includes particle matter, from lean-burn engine etc. As the result, several carbon dioxide and ozone are generated and the particle matter is oxidized by these carbon dioxide and ozone.

Patent Document 7 discloses an exhaust gas breaking apparatus. This exhaust gas breaking apparatus comprises a microwave oscillation device, microwave resonant cavity, microwave radiation means, and ignition means using plasma. The microwave oscillation device generates certain microwave marginal zone. The microwave resonant cavity resonates part of the microwave zone. The microwave radiation means radiates microwave to the microwave resonant cavity. The ignition means forms gas plasma by partly discharging in the gas inside said microwave resonant cavity. Said microwave radiation mean is arranged in circumferential direction in periphery of flow path where exhaust gas flows. Said microwave radiation mean is a microwave radiating antenna with a configuration and size such that a strong electric field place, where plasma generating area generated with microwave becomes the same in the passage section, is generated. Applying this apparatus, carbon-carbon and carbon-hydrogen bonds are broken by the strong oxidation power of ozone and OH radicals along with plasma generation in exhaust gas, including unborn gas, soot, and NOx in combustion/reactive room. As a result, it becomes stabilizes harmless oxide such as $NO_2$ and $CO_2$ or carbon via the chemical reaction involving oxidation and OH radicals. The exhaust gas components are rendered harmless.

[Patent Document 1] Japanese Patent Application Laid-open Publication No. 2002-276333

[Patent Document 2] Japanese Patent Application Laid-open Publication No. 2004-353596

[Patent Document 3] Japanese Patent Application Laid-open Publication No. 2005-502823

[Patent Document 4] Japanese Patent Application Laid-open Publication No. 2004-293522

[Patent Document 5] Japanese Patent Application Laid-open Publication No. 2006-132483

[Patent Document 6] Japanese Patent Application Laid-open Publication No. 2004-169643

[Patent Document 7] Japanese Patent Application Laid-open Publication No. 2007-113570

SUMMARY OF THE INVENTION

In the case of technique in Patent Documents 1 through 6, a particulate filter or other exhaust gas depuration apparatus is installed in much lower place from the portion of the exhaust passage formed in the cylinder head of an internal combustion engine in the light of the layout. Therefore, the temperature of the exhaust gas decreases before reaching the exhaust depuration apparatus from the combustion chamber. For that point, it is thought to clean the exhaust gas effectively by elevating the temperature in the exhaust depuration apparatus so as to promote oxidation reaction etc. of the exhaust gas components in the exhaust gas depuration. However, a rich air-to-fuel ratio or excessive afterburning downstream of the combustion chamber will get terrible mileage of the internal combustion engine.

The inventor of the present invention extrapolated the mechanism of combustion promotion in the internal combustion engine which is disclosed in Patent Document 7, and obtained a constant finding about the mechanism. In this mechanism, a small amount of plasma is discharged firstly. The plasma is irradiated with microwaves for a given period of time, so that the amount of plasma increases. Thus a large amount of OH radicals and ozone is generated from moisture in the air-fuel mixture within a short period of time, promoting an air-fuel mixture reaction. Furthermore, by using a large amount of OH radicals and ozone property, it will be able to promote oxidation reaction of the exhaust gas components.

In the view of the foregoing, the present invention has been achieved. An object of the invention is to provide an after-treatment apparatus to clean the exhaust gas highly efficiently. This after-treatment apparatus uses the combustion camber right after explosion stroke as a reactor. In the reactor, the combustion-promoting mechanism obtained by generating a large amount of OH radicals and ozone with plasma is applied. The oxidation reaction etc. of the exhaust gas components is promoted by providing high temperature exhaust gas with a large amount of OH radicals and ozone. As a result, a highly efficient exhaust gas cleanup is achieved.

The present invention is an after-treatment apparatus for exhaust gas in a combustion chamber, which is installed in an internal combustion engine where a piston fits into a cylinder penetrating a cylinder block to reciprocate freely, a cylinder head is assembled to the anti-crankcase side of the cylinder block with a gasket between it and the cylinder block, an intake port opening on the cylinder head is opened and closed with an intake valve, an exhaust port opening on the cylinder head is opened and closed with an exhaust valve, the combustion chamber is formed by these parts, the after-treatment apparatus comprises, a discharge device with an electrode exposed to the combustion chamber and installed in at least one of the parts constituting the combustion chamber, an antenna installed in at least one of the parts constituting the combustion chamber, so as to radiate electromagnetic waves into the combustion chamber, an electromagnetic wave transmission line installed in at least one of the parts constituting the combustion chamber with one end connected to the antenna and the other end covered with an insulator or dielectric and extending to a portion, in at least one of the parts constituting the combustion chamber, distant from the combustion chamber, and an electromagnetic wave generator for feeding electromagnetic waves to the electromagnetic wave transmission line, the after-treatment apparatus is configured such that discharge is generated with the electrode of the discharge device and the electromagnetic waves fed from the electromagnetic wave generator through the electromagnetic wave transmission line are radiated from the antenna, while the exhaust gas remains in the combustion chamber after the exhaust gas is produced during the explosion stroke.

In the actuation of the internal combustion engine, discharge is generated at the electrode of the discharge device and the electromagnetic waves fed from the electromagnetic wave generator through the electromagnetic wave transmission line are radiated from the antenna. Therefore, the plasma is generated near the electrode. This plasma receives energy of an electromagnetic waves (electromagnetic wave pulse) supplied from the antenna for a given period of time. As a result, the plasma generates a large amount of OH radicals and ozone to promote the oxidation reaction etc. of the exhaust gas components. In fact electrons near the electrode are accelerated, fly out of the plasma area, and collide with gas such as air or the air-fuel mixture in surrounding area of said plasma. The gas in the surrounding area is ionized by these collisions and becomes plasma. Electrons also exist in the newly formed plasma. These also are accelerated by the electromagnetic wave pulse and collide with surrounding gas. The gas ionizes like an avalanche and floating electrons are produced in the surrounding area by chains of these electron acceleration and collision with electron and gas inside plasma. These phenomena spread to the area around discharge plasma in sequence, then the surrounding area get into plasma state. In the result of the phenomena as mentioned above it, the volume of plasma increases. Then the electrons recombine rather than dissociate at the time when the electromagnetic wave pulse radiation is stopped. As a result, the electron density decreases, and the volume of plasma decreases as well. The plasma disappears when the electron recombination is completed. A large amount of OH radicals and ozone is generated from moisture in the gas mixture as a result of a large amount of the generated plasma, promoting the oxidation reaction etc. of the exhaust gas components.

In that case, oxidation reaction etc. is initiated in the combustion chamber as a reactor while exhaust gas remains in the combustion chamber after the exhaust gas is produced during explosion stroke. The high temperature of the exhaust gas also promotes the oxidation reactions, which increases cleanup efficiency in combination with the oxidation reaction etc. obtained by generating a large amount of OH radicals and ozone with plasma. Therefore, it is not necessary to use a rich air-to-fuel ratio or afterburning downstream of the combustion chamber, which would prevent the mileage reduction of the internal combustion engine.

In addition, until the intake valve opens the intake port or the exhaust valve opens the exhaust port after generation exhaust gas by explosion stroke, the electromagnetic waves scattering from the combustion chamber to outside is prevented. Moreover, the back face of the intake valve or the exhaust valve prevents some electromagnetic waves from scattering from the combustion chamber to the intake port or the exhaust port after the intake valve opens the intake port or the exhaust valve opens the exhaust port. Therefore, closed space of the combustion chamber or space according to it becomes a reactor, where the oxidation reaction etc. of the exhaust gas components is stably initiated.

The after-treatment apparatus of the present invention may be applicable for which the after-treatment apparatus is configured such that discharge is generated with the electrode of the discharge device and the electromagnetic waves fed from the electromagnetic wave generator through the electromagnetic wave transmission line are radiated from an antenna, from the time when exhaust gas is produced at the explosion stroke to the time when the intake valve opens the intake port or the exhaust valve opens the exhaust port.

This makes it possible that the intake valve and exhaust valve prevents electromagnetic waves from scattering from the combustion chamber to outside. Therefore, closed space of the combustion chamber becomes a reactor, where the oxidation reaction etc. of the exhaust gas components is stably initiated.

The after-treatment apparatus of the present invention may comprise a crank angle detector for detecting the crank angle of the crank shaft, and a controller for controlling the discharge device and electromagnetic wave generator once they receive a signal from the crank angle detector.

This makes it possible that discharge at the electrode, and the radiation of the electromagnetic waves from the antenna, are controlled according to the crank angle.

The after-treatment apparatus of the present invention may be applicable for which the electrode is located close to a portion that the electric field intensity generated by the electromagnetic waves strengthen in the antenna when the electromagnetic waves are fed into the antenna.

This makes it possible that the electrical field intensity, due to the electromagnetic waves radiated from said portion of the antenna, is stronger than the electrical field intensity of the surrounding electromagnetic waves. Therefore, the energy of the electromagnetic wave pulse is intensively supplied to the plasma generated by discharge at the electrode. As a result, a large amount of OH radicals and ozone is efficiently generated, further promoting the oxidation reaction etc. of the exhaust gas components in the area centered at the electrode. When there are multiple areas of the antenna with strong electrical field intensity, the oxidation reaction etc. of the exhaust gas components at multiple areas of the combustion chamber is further promoted upon the portion approaching to the electrode.

DESCRIPTION OF REFERENCE CHARACTERS

Figure 1:
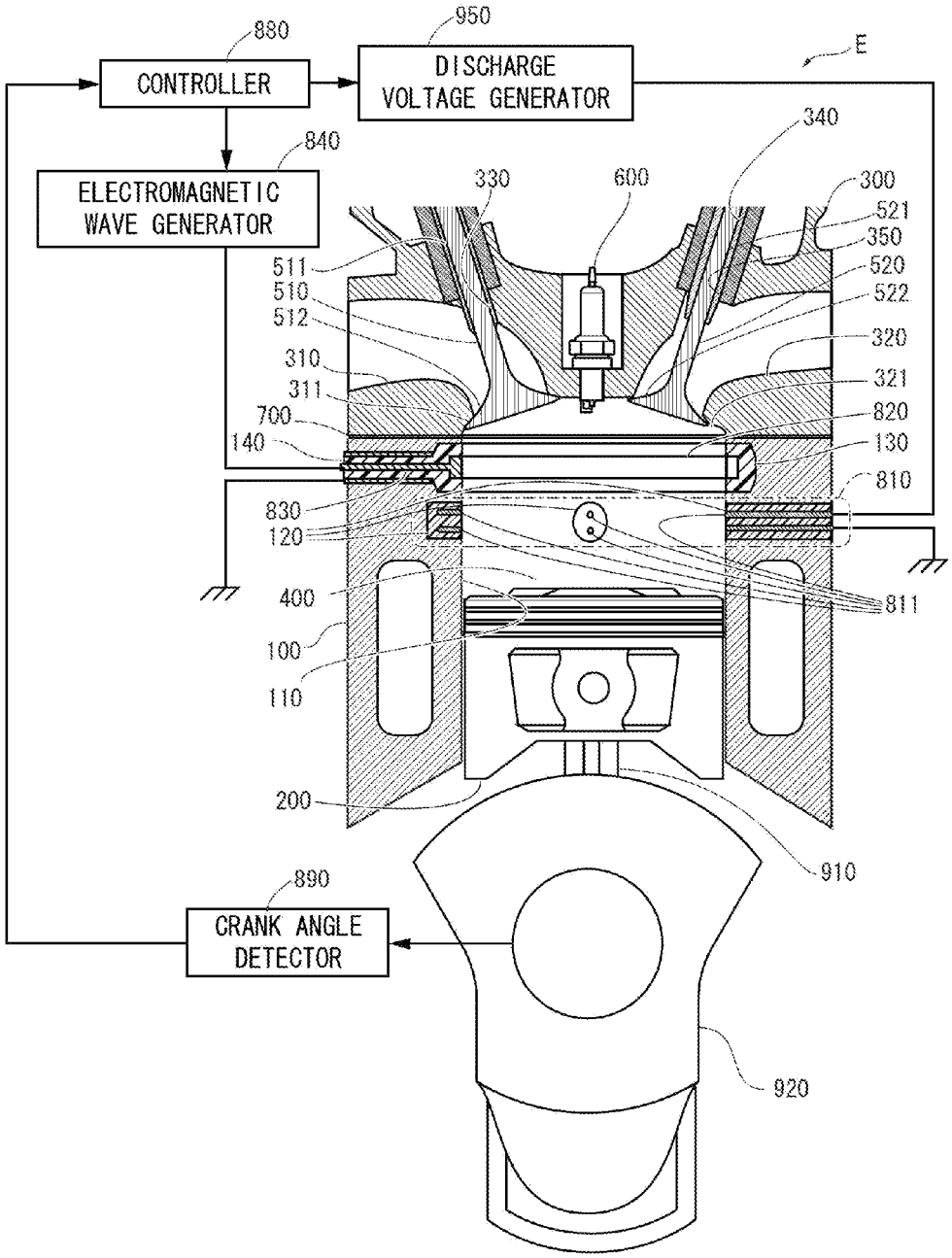
FIG. 1 shows a vertical cross-sectional view of combustion chamber in an internal combustion engine with the after-treatment apparatus for exhaust gas in a combustion chamber in the first embodiment of the present invention.

E Internal combustion engine
100 Cylinder block
110 Cylinder
200 Piston
300 Cylinder head
320 Exhaust port
321 Opening
340 Guide hole
350 Valve guide mounted hole
360 Valve guide
400 Combustion chambers
520 Exhaust valve
521 Valve stem
521*a* Basic portion
521*b* Periphery portion
522 Valve head
522*a* Basic portion
522*b* Valve face
760,810 Discharge device
762,811,812,813 Electrode
770,820 Antenna
780,830 Electromagnetic wave transmission line
840 Electromagnetic wave generator
850 Dielectric member
860 Power-feeding member

DETAILED DESCRIPTION OF THE INVENTION

Hereinafter, embodiments of the present invention will be described. FIG. 1 shows the embodiment of the internal combustion engine E with the after-treatment apparatus for exhaust gas in a combustion chamber of the present invention. The present invention targets reciprocating engines. In this embodiment, engine E is a four-cycle gasoline engine. Item 100 is the cylinder block. Cylinder block 100 contains cylinder 110, which has an approximately circular cross section. Cylinder 110 penetrates cylinder block 100. Piston 200, which has an approximately circular cross section corresponding to cylinder 110, fits into cylinder 110 and reciprocates freely. Cylinder head 300 is assembled on the anti-crankcase side of cylinder block 110. Cylinder head 300, piston 200, and cylinder 110 form combustion chamber 400. Item 910 is a connecting rod, with one end connected to piston 200 and the other end connected to crankshaft 920, which is the output shaft. Cylinder head 300 has intake port 310, which is a component of the intake line, and exhaust port 320, which is a component of the exhaust line. One end of intake port 310 connects to combustion chamber 400; the other end is open at the outside wall of cylinder head 300. One end of intake port 310 is open at the wall of cylinder head 300 face to the cylinder 110; the other end is open at the outside wall of cylinder head 300. One end of exhaust port 320 is open at the wall of cylinder head 300 face to the cylinder 110; the other end is open at the outside wall of cylinder head 300. Cylinder head 300 has guide hole 330 that passes through intake port 310 to the outside wall of cylinder head 300. Rod-shaped valve stem 511 of intake valve 510 fits into guide hole 330 and reciprocates freely. Umbrella-shaped valve head 512, set at the end of valve stem 511, opens and closes the combustion chamber side opening 311 of intake port 310 at a given timing by a valve open/close mechanism having a cam and so on (not shown in the figure). Cylinder head 300 has guide hole 340 that passes through exhaust port 320 to the outside wall of cylinder head 300. Rod-shaped valve stem 521 of exhaust valve 520 fits into guide hole 340 and reciprocates freely. Umbrella-shaped valve head 522, set at the end of valve stem 521, opens and closes the combustion chamber side opening 321 of the exhaust port 320 at a given time by the valve open/close mechanism having cam and so on (not shown in the figure). Item 910 is a connecting rod, with one end connected to piston 200 and the other end connected to crankshaft 920, which is the output shaft. Moreover, cylinder block 100, piston 200, gasket 700, cylinder head 300, intake valve 510, and exhaust valve 520 form combustion chamber 400. Item 600 is a spark plug installed in cylinder head 300 to expose the electrode to combustion chamber 400. Spark plug 600 discharges at the electrodes when piston 200 is near top dead center. Therefore, four strokes (intake, compression, combustion of mixture, and exhaust of exhaust gas) occur while piston 200 reciprocates between top dead center and bottom dead center twice. However, this embodiment does not restrict the interpretation of the internal combustion engine targeted by the present invention. The present invention is also suitable for use with two-stroke internal combustion engines and diesel engines. Target gasoline engines include direct-injection gasoline engines, which create a mixture inside the combustion chamber to inject fuel into the intake air. Target diesel engines include direct-injection diesel engines, which inject fuel into the combustion chamber directly, and divided-chamber diesel engines, which inject fuel into the divided chamber. Internal combustion engine E in this embodiment has four cylinders, but this does not restrict number of cylinders of the internal combustion engine targeted by the present invention. The internal combustion engine for this embodiment has two intake valves 510 and two exhaust valves 520, but this does not restrict the number of intake or exhaust valves of the internal combustion engine targeted by the present invention.

Figure 2:
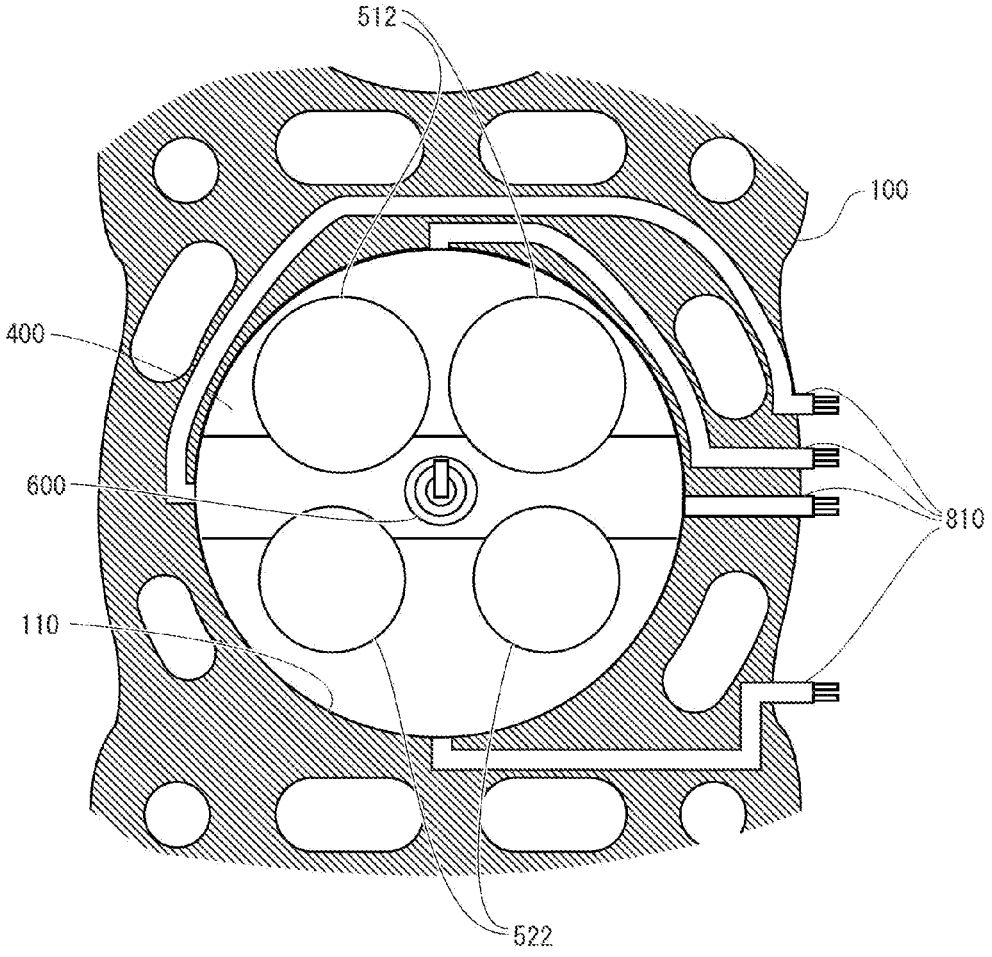
FIG. 2 shows an enlarged cross sectional view of the cylinder block in an internal combustion engine with the after-treatment apparatus for exhaust gas in a combustion chamber in the first embodiment of the present invention, sectioned at the position of the electromagnetic wave transmission line.

The discharge device 810 with electrode 811 exposed to the combustion chamber 400 is installed in the cylinder block 100, as shown in FIGS. 1 and 2. The wall of cylinder 110 in cylinder block 110 contains a hole that penetrates the wall from cylinder side to the outside wall. The first support 120 with tube-shaped is installed in this hole. This first support 120 is made from ceramics. Like this, the first support 120 may be made from dielectric, but it may be made from insulator. One end face of this first support 120 is the same level with the cylinder 110 wall. This first support 120 is exposed to cylinder 110, and the other end of this first support 120 reaches the outside wall of cylinder block 100. And, discharge device 810 is installed in the first support 120. The discharge device 810 only has to be made from a conductor although it is made from the copper wire. A couple of discharge device 810 is buried in the first support 120, and it goes though the first support 120. The end face of each discharge device 810 is the same level with the wall of the cylinder 110. The end face of each discharge device 810 exposes to cylinder 110 and composes electrode 811. The other end of each discharge device 810 is extracted from the outside wall of cylinder block 100 to outside. In one of a pair discharge devices 810, the end portion that exposed from the outside wall of cylinder block is connected to discharge voltage generator 950 which generates voltage for discharge. In another of a pair discharge devices 810, the end portion that exposed from the outside wall of cylinder block is earthed. Here, the discharge voltage generator discharge 950 is DC 12V power supply, but it may be used for example piezo element or other device. When the discharge voltage generator 950 applies the voltage between a pair of discharge devices 810, the discharge is generated between a pair of electrodes 811. As a modification, the number of the discharge line, buried and passes thorough the first support, may be one. In this case, the discharge voltage generator is connected with the discharge line, and the voltage is applied with the discharge voltage generator between the discharge line and cylinder blocks which is the earth member. Then, the discharge is generated between the electrode of the discharge line and the cylinder block. In this embodiment, four discharge lines are installed, these are arranged so that their four electrodes are located at approximately equal intervals to the circumferential direction of cylinder 110, as shown in FIG. 2. However, this after-treatment apparatus for exhaust gas requires only more than one discharge device installation, and number of discharge devices and its location are not cause of restrict interpretation by this embodiment. In this embodiment, part of discharge line 810 except the electrode and the electrode 811 are formed from the same material as one body. However, part of discharge line except the electrode and the electrode are formed separately and connected. Part of discharge line 760 except the electrode and the electrode are made from the different material. The spark plug can be used as a discharge device. The discharge device requires generating plasma by discharge regardless the size.

Figure 3:
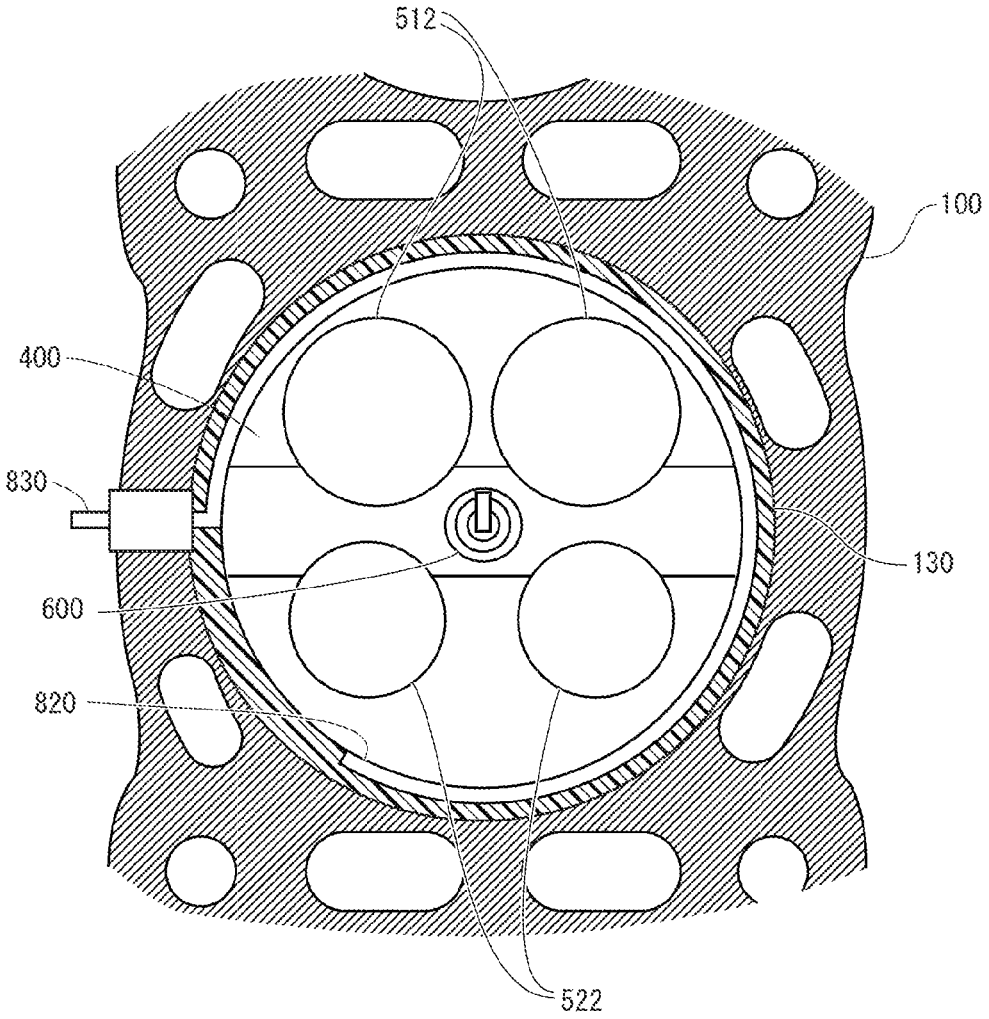
FIG. 3 shows an enlarged cross sectional view of the cylinder block in an internal combustion engine with the after-treatment apparatus for exhaust gas in a combustion chamber in the first embodiment of the present invention, sectioned at the position of the antenna.

Antenna 820 is installed in cylinder block 100 to radiate the electromagnetic waves into combustion chamber 400, as shown in FIGS. 1 and 3. The groove that dents in the direction where the radius of cylinder 110 expands and extends in circumferential direction of cylinder 110 is installed on the wall of cylinder 110 in cylinder block 100. The second support 130 is installed in this groove, and it orbits in circumferential direction to be ring-shaped. This second support 130 is made from ceramics. Although the second support 130 could be formed from the dielectric substance, also could be formed from insulator. An inner side wall of second support 130 is at the same level with the cylinder 110 wall and it is exposed to cylinder 110. And, antenna 820 is installed in the second support 130. This antenna 820 is made from metal. This antenna 820 may be made from conductor or dielectric or insulator and so on. However, electromagnetic waves must be radiated from the antenna to the combustion chamber well upon supplying electromagnetic waves between the antenna and the earth member. This antenna 820 is bar-style, and has almost curved to a circular arc type along the wall of cylinder 110. For example, the length of the antenna 820 is set to a quarter of wavelength in electromagnetic waves, standing wave is generated in the antenna 820. Thus, electrical field strength at the end of antenna 820 becomes strong. For example, the length of the antenna 820 is set to a multiple of a quarter wavelengths of the electromagnetic waves so that standing waves are generated in the antenna 820, increasing the electrical field at multiple points, where the anti-nodes of the standing waves are generated, in the antenna 820. Here, antenna 820 is buried in the second support 130. An inner surface of antenna 820 is the same level of the cylinder wall of 110 and is exposed to cylinder 110. As shown in FIG. 1, the solid cross-section of antenna 820 is approximately rectangle for its entire length. Antenna 820 is exposed to cylinder 100 at one side on the circumference of circle or its entire length. However, antenna 820 of the after-treatment apparatus for exhaust gas of the present invention is not restricted to a rectangle cross-sectional shape. Antenna 820 may be completely buried in the second support. Additionally, the electrode 811 is located close to a portion that electric field intensity generated by the electromagnetic waves becomes strong in the antenna 820 when the electromagnetic waves are fed to the antenna 820. In here, the end of antenna 820 and the electrode 811 are close to each other along the wall of combustion chamber 400 at specified intervals. Thus, when electromagnetic waves are supplied between antenna 820 and said earth cylinder block 100, the electromagnetic waves are radiated from antenna 820 into combustion chamber 400. For this embodiment, antenna 820 is a rod-shaped monopole antenna that is curved one. However, this does not restrict the type of antenna in the after-treatment apparatus for exhaust gas of the present invention. Therefore, antenna of the after-treatment apparatus for exhaust gas of the present invention may be dipole type, Yagi-Uda type, single wire type, loop type, phase difference feeder type, grounded type, ungrounded and perpendicular type, beam type, horizontal polarized omni-directional type, corner-reflector type, comb type or other type of linear antenna, microstrip type, planar inverted F type or other type of flat antenna, slot type, parabola type, horn type, horn reflector type, Cassegrain type or other type of solid antenna, Beverage type or other type of traveling-wave antenna, star EH type, bridge EH type or other type of EH antennas, bar type, small loop type or other type of magnetic antenna, or dielectric antenna.

Electromagnetic wave transmission line 830 is installed in cylinder block 100. One of the electromagnetic wave transmission lines 830 is connected with the antenna 820. The other end of electromagnetic wave transmission line 830 is covered with a dielectric, and extends to a portion of the cylinder block 100, distant from the combustion chamber 400. The wall of cylinder 110 in cylinder block 110 contains a hole that penetrates the wall from periphery side of second support 130 to the outside wall. The third support 140 with tube-shaped is installed in this hole. This third support 140 is made from ceramics. Like this, the third support 140 may be made from dielectric, but it may be made from insulator. One of the third support 140 ends is connected with a side which is farther from cylinder 110 on the second support 130. The other end of the third support 140 reaches the outside wall of cylinder block 100. And electromagnetic wave transmission line 830 is installed in the third support 140. The electromagnetic wave transmission line 830 is made from copper wire. The electromagnetic wave transmission line 830 may be made from conductor, dielectric, or insulator and so on. However, electromagnetic waves must be transmitted well to the antenna 820 upon supplying electromagnetic waves between the earthed member and the electromagnetic wave transmission line. A variation example of the electromagnetic waves transmission line is an electromagnetic waves transmission line which consists of a waveguide made from conductor or dielectric. Here, the electromagnetic wave transmission line 830 is buried in the third support 140, and pass through the third support 140. One end of the electromagnetic wave transmission line 830 is connected with the antenna 820. The other end of the electromagnetic wave transmission line 830 is extracted from the outside wall of cylinder block 100 to outside. Thus, when electromagnetic waves are supplied between electromagnetic wave transmission line 830 and cylinder block 100 that is the earth member, they are introduced into antenna 820.

Electromagnetic wave generator 840, which supplies electromagnetic waves to electromagnetic wave transmission line, is installed in internal combustion engine E or its surroundings. Electromagnetic wave generator 840 generates electromagnetic waves. In this embodiment of electromagnetic wave generator 840 is a magnetron that generates 2.45-GHz-bandwidth microwaves. However, this does not restrict interpretation of composition of electromagnetic wave generator of the after-treatment apparatus for gas of the present invention.

Figure 4:
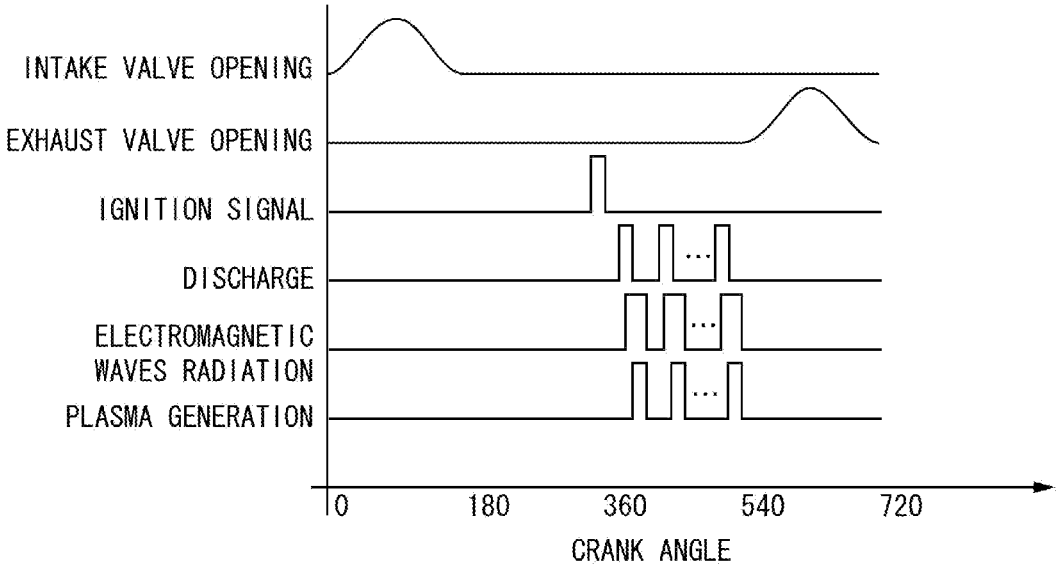
FIG. 4 shows an explanation chart which explains the operation of the after-treatment apparatus for exhaust gas in a combustion chamber in the first embodiment of the present invention.

And discharge is generated with the electrode 811 of the discharge device 810 and the electromagnetic waves fed from the electromagnetic wave generator 840 through the electromagnetic wave transmission line 830 are radiated from the antenna 820, while the exhaust gas remains in the combustion chamber 400 after the exhaust gas is produced during the explosion stroke in this after-treatment apparatus for gas. In addition, discharge is generated with the electrode 811 of the discharge device 810 and the electromagnetic waves fed from the electromagnetic wave generator 840 through the electromagnetic wave transmission line 830 are radiated from an antenna 820 from the time when exhaust gas is produced at the explosion stroke to the time when the intake valves 510 open the intake ports 310 or the exhaust valves 520 open the exhaust ports 320 in this after-treatment apparatus for gas (Refer to FIG. 4). Cylinder block 100 is earthed. The earth terminals of discharge voltage generator 950 and electromagnetic wave generator 840 are earthed. Discharge voltage generator 950 and electromagnetic wave generator 840 are controlled by controller 880, which has a CPU, memory, and storage etc, and outputs control signals after computing input signals. A signal line from crank angle detector 890 for detecting crank angle of crankshaft 920 is connected to control unit 880. Crank angle detection signals are sent from crank angle detector 890 to controller 880. Therefore, controller 880 receives signals from crank angle detector 890 and controls the actuations of discharge device 810 and electromagnetic wave generator 840. However, this does not restrict the control method and the composition of the input-output signals as for the after-treatment apparatus for exhaust gas in a combustion chamber of the present invention.

Figure 5:
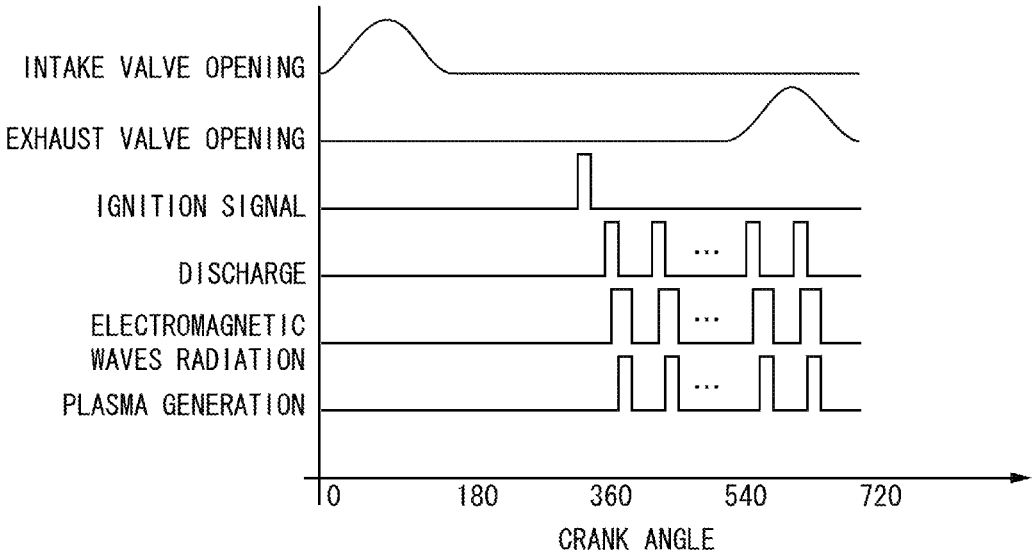
FIG. 5 shows an explanation chart which explains the another operation of the after-treatment apparatus for exhaust gas in a combustion chamber in the first embodiment of the present invention.

As a modification, the setting of controller 880 is changed from said embodiment. In this after-treatment apparatus for exhaust gas in a combustion chamber, discharge is generated with the electrode 811 of the discharge device 810 and the electromagnetic waves fed from the electromagnetic wave generator 840 through the electromagnetic wave transmission line 830 are radiated from an antenna 820 from the time when exhaust gas is produced at the explosion stroke to not the time when the intake valves 510 open the intake ports 310 or the exhaust valves 520 open the exhaust ports 320 but the time after the exhaust valves 520 begin to open (Refer to FIG. 5).

In the actuation of the internal combustion engine E, discharge is generated at the electrode 811 of the discharge device 810 and the electromagnetic waves fed from the electromagnetic wave generator 840 through the electromagnetic wave transmission line 830 are radiated from the antenna 820. Therefore, the plasma is generated near the electrode 811. This plasma receives energy of an electromagnetic waves (electromagnetic wave pulse) supplied from the antenna 820 for a given period of time. As a result, the plasma generates a large amount of OH radicals and ozone to promote the oxidation reaction etc. of the exhaust gas components. In fact electrons near the electrode are accelerated, fly out of the plasma area, and collide with gas such as air or the air-fuel mixture in surrounding area of said plasma. The gas in the surrounding area is ionized by these collisions and becomes plasma. Electrons also exist in the newly formed plasma. These also are accelerated by the electromagnetic wave pulse and collide with surrounding gas. The gas ionizes like an avalanche and floating electrons are produced in the surrounding area by chains of these electron acceleration and collision with electron and gas inside plasma. These phenomena spread to the area around discharge plasma in sequence, then the surrounding area get into plasma state. In the result of the phenomena as mentioned above it, the volume of plasma increases. Then the electrons recombine rather than dissociate at the time when the electromagnetic wave pulse radiation is stopped. As a result, the electron density decreases, and the volume of plasma decreases as well. The plasma disappears when the electron recombination is completed. A large amount of OH radicals and ozone is generated from moisture in the gas mixture as a result of a large amount of the generated plasma, promoting the oxidation reaction etc. of the exhaust gas components.

In that case, oxidation reaction etc. is initiated in the combustion chamber 400 as a reactor while exhaust gas remains in the combustion chamber 400 after the exhaust gas is produced during explosion stroke. The high temperature of the exhaust gas also promotes the oxidation reactions, which increases cleanup efficiency in combination with the oxidation reaction etc. obtained by generating a large amount of OH radicals and ozone with plasma. Therefore, it is not necessary to use a rich air-to-fuel ratio or afterburning downstream of the combustion chamber, which would prevent the mileage reduction of the internal combustion engine.

In addition, until the intake valves 510 open the intake ports 310 or the exhaust valves 520 open the exhaust ports 320 after generation exhaust gas by explosion stroke, The electromagnetic waves scattering from the combustion chamber 400 to outside is prevented. Moreover, the back face of the intake valves 510 or the exhaust valves 520 prevent some electromagnetic waves from scattering from the combustion chamber 400 to the intake port 310 or the exhaust port 320 after the intake valves 510 open the intake ports 310 or the exhaust valves 510 opens the exhaust ports 320. Therefore, closed space of the combustion chamber 400 or space according to it becomes a reactor, where the oxidation reaction etc. of the exhaust gas components is stably initiated.

The after-treatment apparatus for exhaust gas in a combustion chamber of the present invention may be configured such that discharge is generated with the electrode of the discharge device and the electromagnetic waves fed from the electromagnetic wave generator through the electromagnetic wave transmission line are radiated from the antenna, while the exhaust gas remains in the combustion chamber after the exhaust gas is produced during the explosion stroke. Control method shown in FIG. 5 and explained is one example. Even though there are various embodiments, the after-treatment apparatus for exhaust gas in a combustion chamber of the first embodiment is configured such that discharge is generated with the electrode 811 of the discharge device 810 and the electromagnetic waves fed from the electromagnetic wave generator 840 through the electromagnetic wave transmission line 830 are radiated from an antenna 820, from the time when exhaust gas is produced at the explosion stroke to the time when the intake valves 510 open the intake ports 310 or the exhaust valves 520 open the exhaust ports 320, as the explanation using FIG. 4. This makes it possible that the intake valves 510 and exhaust valves 520 prevent electromagnetic waves from scattering from the combustion chamber 400 to outside. Therefore, closed space of the combustion chamber 400 becomes a reactor, where the oxidation reaction etc. of the exhaust gas components is stably initiated.

The after-treatment apparatus for exhaust gas in a combustion chamber of the present invention may be configured such that discharge is generated with the electrode of the discharge device and the electromagnetic waves fed from the electromagnetic wave generator through the electromagnetic wave transmission line are radiated from the antenna, while the exhaust gas remains in the combustion chamber after the exhaust gas is produced during the explosion stroke. This does not restrict the control method and the composition of the input-output signals of discharge device or electromagnetic wave generator. Even though there are various embodiments, the after-treatment apparatus for exhaust gas in a combustion chamber of the first embodiment comprises crank angle detector 890 and controller 880. Crank angle detector 890 detects the crank angle of crank shaft 920. Controller 880 receives the signal from this crank angle detector 890, and controls the operation of discharge device 810 and electromagnetic wave generator 840. This makes it possible that discharge at the electrode 811 and the radiation of the electromagnetic waves from the antenna 820 are controlled according to the crank angle.

The positional relationship between the antenna and the electrodes is not restricted in the after-treatment apparatus for exhaust gas in a combustion chamber of the present invention. Even though there are various embodiments, the electrode 811 is located close to a portion that the electric field intensity generated by the electromagnetic waves strengthens in the antenna 820 when the electromagnetic waves are fed into the antenna 820 in the after-treatment apparatus for exhaust gas in a combustion chamber of the first embodiment. This makes it possible that the electrical field intensity, due to the electromagnetic waves radiated from said portion of the antenna 820, is stronger than the electrical field intensity of the surrounding electromagnetic waves. Therefore, the energy of the electromagnetic wave pulse is intensively supplied to the plasma generated by discharge at the electrode 811. As a result, a large amount of OH radicals and ozone is efficiently generated, further promoting the oxidation reaction etc. of the exhaust gas components in the area centered at the electrode 811. When there are multiple areas of the antenna 820 with strong electrical field intensity, the oxidation reaction etc. of the exhaust gas components at multiple areas of the combustion chamber 400 is further promoted upon the portion approaching to the electrode 811.

Next, other embodiments of the after-treatment apparatus for exhaust gas in a combustion chamber of the present invention will be described. In the after-treatment apparatus for exhaust gas in first embodiment, discharge devices 810, antenna 820, and electromagnetic wave transmission line 830 are installed in the cylinder block 100 of the members constituting the combustion chamber 400. In the after-treatment apparatus for exhaust gas in second embodiment, discharge device 760, antenna 770, and electromagnetic wave transmission line 780 were installed in the gasket 700 of the members constituting the combustion chamber 400.

Figure 6:
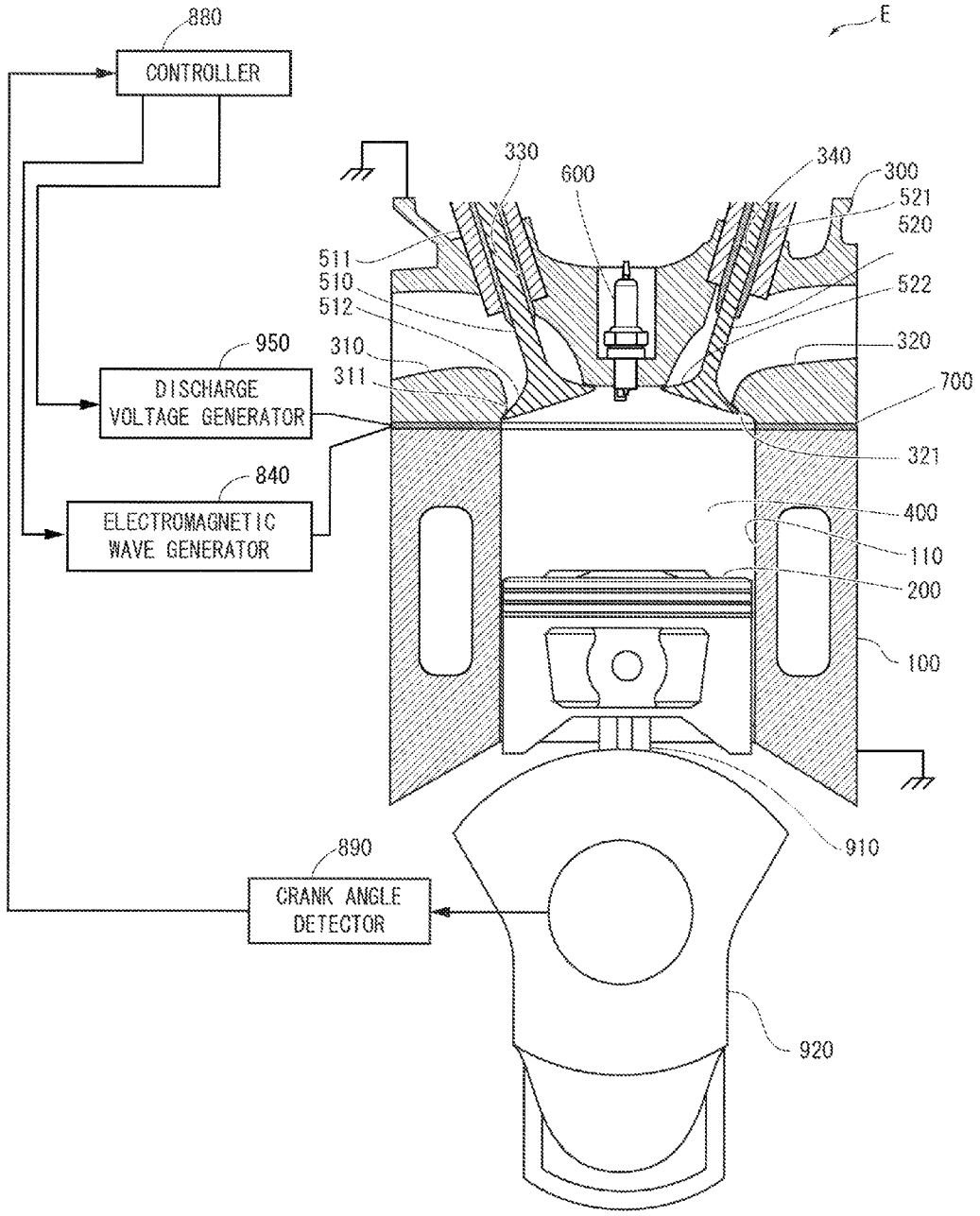
FIG. 6 shows a vertical cross-sectional view of combustion chamber in an internal combustion engine with the gasket used by the after-treatment apparatus for exhaust gas in the second embodiment of the present invention.

Hereinafter, the after-treatment apparatus for exhaust gas in a combustion chamber in second embodiment will be described. FIG. 6 shows the embodiment of the internal combustion engine E with the gasket 700. The present invention targets reciprocating engines. In this embodiment, engine E is a four-cycle gasoline engine. Item 100 is the cylinder block. Cylinder block 100 contains cylinder 110, which has an approximately circular cross section. Cylinder 110 penetrates cylinder block 100. Piston 200, which has an approximately circular cross section corresponding to cylinder 110, fits into cylinder 110 and reciprocates freely. Cylinder head 300 is assembled on the anti-crankcase side of cylinder block 110. Cylinder head 300, piston 200, and cylinder 110 form combustion chamber 400. Item 910 is a connecting rod, with one end connected to piston 200 and the other end connected to crankshaft 920, which is the output shaft. Cylinder head 300 has intake port 310, which is a component of the intake line, and exhaust port 320, which is a component of the exhaust line. One end of intake port 310 connects to combustion chamber 400; the other end is open at the outside wall of cylinder head 300. One end of exhaust port 320 connects to combustion chamber 400; the other end is open at the outside wall of cylinder head 300. The cylinder head has guide hole 330 that passes through intake port 310 to the outside wall of cylinder head 300. Valve stem 511 of intake valve 510 fits into guide hole 330 and reciprocates freely. Valve head 512, set at the end of valve stem 511, opens and closes the combustion chamber side opening of intake port 310 at a given timing by a valve open/close mechanism having a cam and so on (not shown in the figure). Cylinder head 300 has guide hole 340 that passes through exhaust port 320 to the outside wall of cylinder head 300. Valve stem 521 of exhaust valve 520 fits into guide hole 340 and reciprocates freely. Valve head 522, set at the end of valve stem 521, opens and closes the combustion chamber side opening 321 of the exhaust port 320 at a given time by the valve open/close mechanism having cam and so on (not shown in the figure). Item 600 is a spark plug installed in cylinder head 300 to expose the electrode to combustion chamber 400. Spark plug 600 discharges at the electrodes when piston 200 is near top dead center. Therefore, four strokes (intake, compression, combustion of mixture, and exhaust of exhaust gas) occur while piston 200 reciprocates between top dead center and bottom dead center twice. However, this embodiment does not restrict the interpretation of the internal combustion engine targeted by the present invention. The present invention is also suitable for use with two-stroke internal combustion engines and diesel engines. Target gasoline engines include direct-injection gasoline engines, which create a mixture inside the combustion chamber to inject fuel into the intake air. Target diesel engines include direct-injection diesel engines, which inject fuel into the combustion chamber directly, and divided-chamber diesel engines, which inject fuel into divided chamber. Internal combustion engine E in this embodiment has four cylinders, but this does not restrict number of cylinders of the internal combustion engine targeted by the present invention. The internal combustion engine for this embodiment has two intake valves 510 and two exhaust valves 520, but this does not restrict the number of intake or exhaust valves of the internal combustion engine targeted by the present invention.

Figure 7:
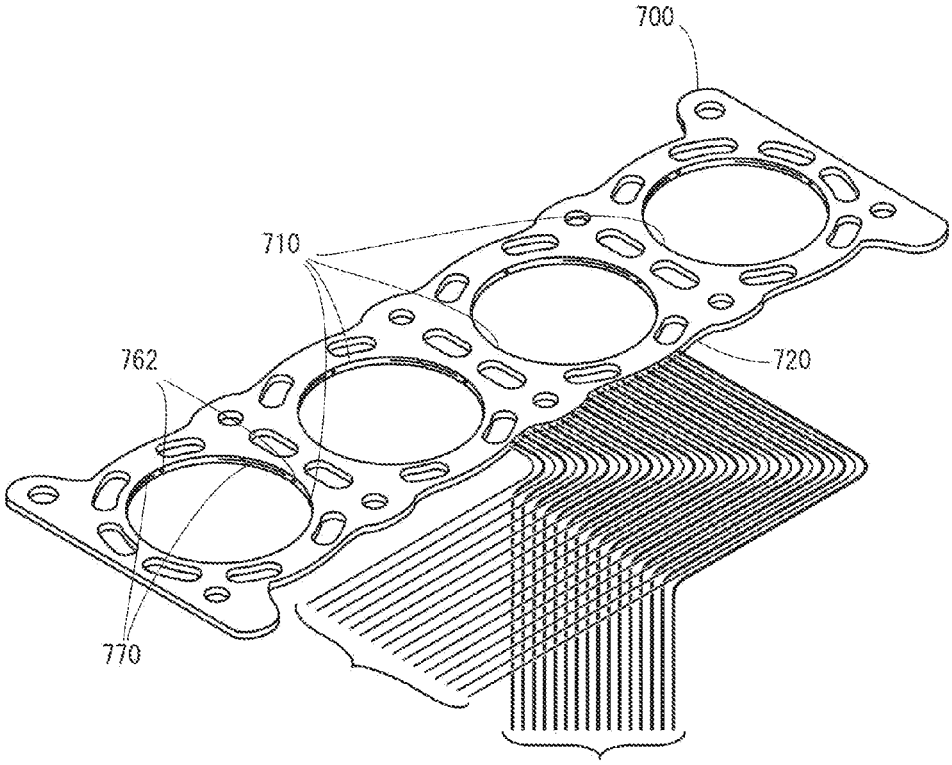
FIG. 7 shows a diagrammatic perspective view of the gasket used by the after-treatment apparatus for exhaust gas in the second embodiment of the present invention.

Gasket 700 shown in FIG. 7 is installed between cylinder block 100 and cylinder head 300. Gasket 700 is shaped like a thin board with an almost constant thickness. Gasket 700 has an opening corresponding to cylinder 110. Additionally, gasket 700 has holes corresponding to the water jacket and bolt holes. These do not restrict interpretation of the gasket shape targeted by the present invention.

Figure 8:
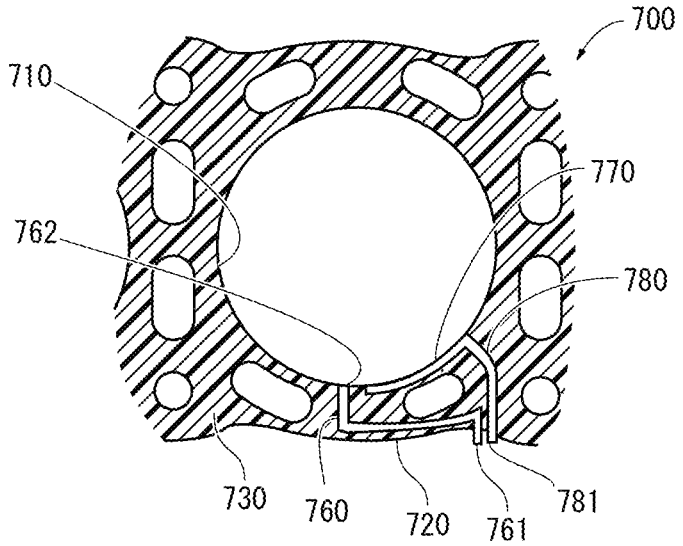
FIG. 8 shows a cross-sectional view of near one opening of the gasket, along the surface of it seen from thickness direction, used by the after-treatment apparatus for exhaust gas in the second embodiment of the present invention.
Figure 9:
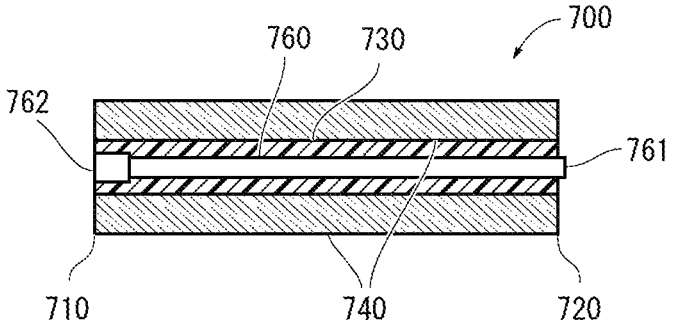
FIG. 9 shows an enlarged vertical cross-sectional view of the gasket, along the discharge line, used by the after-treatment apparatus for exhaust gas in the second embodiment of the present invention.

As shown in FIGS. 8 and 9, discharge line 760 is installed in intermediate layer 730 of gasket 700 in thickness direction as a discharge device. The intermediate layer 730 in thickness direction is a layer formed in the middle part of the direction of thickness. The intermediate layer 730 is made from ceramics. Intermediate layer can also be made from synthetic rubbers, fluoroplastics, silicone resin, synthetic resin, such as a meta system of aramid fiber seats, and heatproof paper. Thus, the intermediate layer may be made from a dielectric, but made from an insulator. Discharge line 760 is made from copper line, but may be made from another conductive material. Discharge line 760 is buried between outer peripheral edge 720 and opening 710 of gasket 700. The outside edge of discharge line 760 is exposed from outer peripheral edge 720 of gasket 700 to become first connector 761. Moreover, the inside edge of the discharge line 760 is exposed from the outer edge of the gasket 700 towards the center of opening 710 to become electrode 762. Surface layers 740, which exist on both sides of intermediate layer 730 in thickness direction, are made from a conductive material. One surface layer 740 comes in contact with one surface of cylinder block 100 when gasket 700 is installed between cylinder block 100 and cylinder head 300. The other surface layer 740 comes in contact with one surface of cylinder head 300. Surface layers 740 are made from metal, although they could also be made from other materials. Although both surface layers 740 in thickness direction are made from a conductive material in this embodiment, the present invention includes the case in which only one surface layer to the intermediate layer 730 in thickness direction is made from a conductive material. Therefore, when the cylinder block 100, cylinder head 300 or surface layer 740 is earthed, and voltage is applied between first connector 761 and an earth member, which can be the cylinder block 100, cylinder head 300 or surface layers 740, a discharge is generated between first connector 761 and the earth member. In this embodiment, part of discharge line 760 except the electrode and the electrode are formed from the same material as one body. However, part of discharge line except the electrode and the electrode are formed separately and connected. Part of discharge line 760 except the electrode and the electrode are made from the different material.

Figure 10:
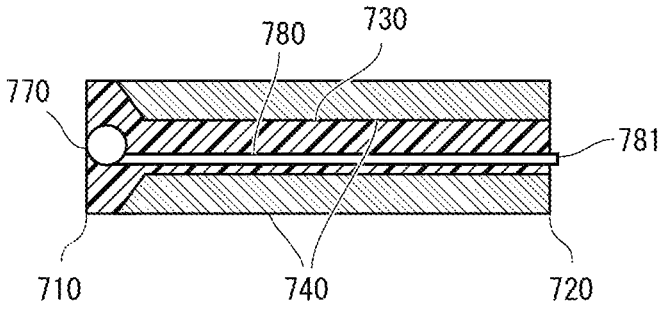
FIG. 10 shows an enlarged vertical cross-sectional view of the gasket, along the electromagnetic wave transmission line, used by the after-treatment apparatus for exhaust gas in the second embodiment of the present invention.

As shown in FIGS. 8 and 10, antenna 770 is installed in gasket 700. Antenna 770 is made from metal, although it could also be made from any conductive material, insulator, or dielectric provided that electromagnetic waves radiate well from the antenna to the combustion chamber when they are applied between the antenna and the earthed members. Antenna 770 is installed in gasket intermediate layer 730 in thickness direction at the inner peripheral edge around opening 710 to radiate electromagnetic waves to the combustion chamber 400. Antenna 770 is rod-shaped. Its base end is installed in intermediate layer 730 in thickness direction. A part to leading end except said base end in this antenna 770 is curved in a nearly circular arc. Antenna 770 extends along the inner peripheral edge around the opening 710 in the circumferential direction of the opening 710. For example, the length of the circular arc part of antenna 770 is set to a quarter of the wavelength of the electromagnetic waves so that standing waves are generated in the antenna 770, increasing the electrical field strength at the end of the antenna 770. For example, the length of the circular arc part of antenna 770 is set to a multiple of a quarter wavelengths of the electromagnetic waves so that standing waves are generated in the antenna 770, increasing the electrical field at multiple points, where the anti-nodes of the standing waves are generated, in the antenna 770. Here, the entire length of antenna 770 is almost buried in intermediate layer 730. As shown in FIG. 10, the solid cross-section of antenna 770 is approximately circular for its entire length. The antenna 770 contacts a surface which is an inner edge of opening 710 of intermediate layer 730 from the inside at one concyclic point in the section along its entire length. This part of antenna 770 is exposed from the inner edge of opening 710 to combustion chamber 400 on the section. However, antenna 770 of the present invention is not restricted to a circular cross-sectional shape. Antenna 770 may be buried in intermediate layer 730 completely. Additionally, said electrode 762 is located close to a portion of strong electrical field intensity in the antenna 770 due to the electromagnetic waves when the electromagnetic waves are fed to the antenna 770. Here, the leading end of antenna 770 and electrode 762 are close to each other along the inner peripheral edge of opening 710, with a prescribed gap between them. As a result, a stripline track is formed. Thus, when electromagnetic waves are supplied between first connector 761 and said earth member, the electromagnetic waves are radiated from antenna 770 to combustion chamber 400. The earth member may double as the earth side of the stripline track concurrently. For this embodiment, antenna 770 is a rod-shaped monopole antenna that is curved one. However, this does not restrict the type of antenna in the gasket of the present invention. Therefore, antenna of the gasket of the present invention may be dipole type, Yagi-Uda type, single wire type, loop type, phase difference feeder type, grounded type, ungrounded and perpendicular type, beam type, horizontal polarized omni-directional type, corner-reflector type, comb type or other type of linear antenna, microstrip type, planar inverted F type or other type of flat antenna, slot type, parabola type, horn type, horn reflector type, Cassegrain type or other type of solid antenna, Beverage type or other type of traveling-wave antenna, star EH type, bridge EH type or other type of EH antennas, bar type, small loop type or other type of magnetic antenna, or dielectric antenna.

As shown in FIGS. 8 and 10, antenna 770 is installed in gasket 700. Antenna 770 is made from metal, although it could also be made from any conductive material, insulator, or dielectric provided that electromagnetic waves radiate well from the antenna to the combustion chamber when they are applied between the antenna and the earthed members. Antenna 770 is installed in gasket intermediate layer 730 in thickness direction at the inner peripheral edge around opening 710 to radiate electromagnetic waves to the combustion chamber 400. Antenna 770 is rod-shaped. Its base end is installed in intermediate layer 730 in thickness direction. A part to leading end except said base end in this antenna 770 is curved in a nearly circular arc. Antenna 770 extends along the inner peripheral edge around the opening 710 in the circumferential direction of the opening 710. For example, the length of the circular arc part of antenna 770 is set to a quarter of the wavelength of the electromagnetic waves so that standing waves are generated in the antenna 770, increasing the electrical field strength at the end of the antenna 770. For example, the length of the circular arc part of antenna 770 is set to a multiple of a quarter wavelengths of the electromagnetic waves so that standing waves are generated in the antenna 770, increasing the electrical field at multiple points, where the anti-nodes of the standing waves are generated, in the antenna 770. Here, the entire length of antenna 770 is almost buried in intermediate layer 730. As shown in FIG. 10, the solid cross-section of antenna 770 is approximately circular for its entire length. The antenna 770 contacts a surface which is an inner edge of opening 710 of intermediate layer 730 from the inside at one concyclic point in the section along its entire length. This part of antenna 770 is exposed from the inner edge of opening 710 to combustion chamber 400 on the section. However, antenna 770 of the present invention is not restricted to a circular cross-sectional shape. Antenna 770 may be buried in intermediate layer 730 completely. Additionally, said electrode 762 is located close to a portion of strong electrical field intensity in the antenna 770 due to the electromagnetic waves when the electromagnetic waves are fed to the antenna 770. Here, the leading end of antenna 770 and electrode 762 are close to each other along the inner peripheral edge of opening 710, with a prescribed gap between them. As a result, a stripline track is formed. Thus, when electromagnetic waves are supplied between first connector 761 and said earth member, the electromagnetic waves are radiated from antenna 770 to combustion chamber 400. The earth member may double as the earth side of the stripline track concurrently. For this embodiment, antenna 770 is a rod-shaped monopole antenna that is curved one. However, this does not restrict the type of antenna in the gasket of the present invention. Therefore, antenna of the gasket of the present invention may be dipole type, Yagi-Uda type, single wire type, loop type, phase difference feeder type, grounded type, ungrounded and perpendicular type, beam type, horizontal polarized omni-directional type, corner-reflector type, comb type or other type of linear antenna, microstrip type, planar inverted F type or other type of flat antenna, slot type, parabola type, horn type, horn reflector type, Cassegrain type or other type of solid antenna, Beverage type or other type of traveling-wave antenna, star EH type, bridge EH type or other type of EH antennas, bar type, small loop type or other type of magnetic antenna, or dielectric antenna.

As shown in FIGS. 8 and 10, electromagnetic wave transmission line 780 is installed in intermediate layer 730 of gasket 700 in thickness direction. Electromagnetic wave transmission line 780 is made from copper line, although it could also be made from any conductive material, insulator, or dielectric provided that electromagnetic waves are transmitted well to the antenna 770 when they are supplied between the antenna and the earthed member. An example of a variation of the electromagnetic wave transmission line is one that consists of a waveguide made from a conductive material or dielectric. Electromagnetic wave transmission line 780 is buried between outer peripheral edge 720 and opening 710 in gasket 700. The outside edge of electromagnetic wave transmission line 780 is exposed from outer peripheral edge 720 of gasket 700 to become second connector 781. The inside edge of electromagnetic wave transmission line 780 connects with antenna 770 in intermediate layer 730. Thus, the electromagnetic waves are led to antenna 770 when electromagnetic waves are supplied between second connector 781 and the earthed member.

Gasket 700 electrically insulates discharge line 760, antenna 770, electromagnetic wave transmission line 780, and both surfaces of the gasket in thickness direction. Cylinder block 100, cylinder head 300, or surface layer 740 is earthed. The anode of discharge voltage generator 950 is connected to first connector 761. The anode of electromagnetic wave generator 840 is connected to second connector 781. The earth terminals of discharge voltage generator 950 and electromagnetic wave generator 840 are earthed. Discharge voltage generator 950 and electromagnetic wave generator 840 are controlled by controller 880, which has a CPU, memory, and storage etc, and outputs control signals after computing input signals. A signal line from crank angle detector 890 for detecting crank angle of crankshaft 920 is connected to control unit 880. Crank angle detection signals are sent from crank angle detector 890 to controller 880. Therefore, controller 880 receives signals from crank angle detector 890 and controls the actuations of discharge device 760 and electromagnetic wave generator 840. Discharge voltage generator 950 in this embodiment is a 12-V DC power source, but this can also be a piezo element or other device. Electromagnetic wave generator 840 generates electromagnetic waves. Electromagnetic wave generator 840 in this embodiment is a magnetron that generates 2.4-GHz-bandwidth microwaves. However, this does not restrict the control method and the composition of the input-output signals as for gasket of the present invention.

Therefore, the gasket is installed between the cylinder block 100 and cylinder head 300 so that its opening 710 corresponds to the cylinder 110. A piston 200 fits into the cylinder 110 and reciprocates freely. The internal combustion engine E operating normally as a gasoline engine is assembled up. It makes possible to apply voltage between first connector 761 of the discharge line 760 and the earth member. It makes possible to feed electromagnetic waves between the second connector 781 and the earth member for a constant time. And voltage is applied to the first connector 761 of the discharge line 760 and the earthed member and the electromagnetic waves are fed to the second connector 781 of the electromagnetic wave transmission line and the earthed member while the exhaust gas remains in the combustion chamber after the exhaust gas is produced in the actuation of the internal combustion engine E. Therefore, the plasma is generated near the electrode 762. This plasma receives energy of an electromagnetic waves (electromagnetic wave pulse) supplied from the antenna 770 for a given period of time. As a result, the plasma generates a large amount of OH radicals and ozone to promote the oxidation reaction etc. of the exhaust gas components. In fact electrons near the electrode 762 are accelerated, fly out of the plasma area, and collide with gas such as air or the air-fuel mixture in surrounding area of said plasma. The gas in the surrounding area is ionized by these collisions and becomes plasma. Electrons also exist in the newly formed plasma. These also are accelerated by the electromagnetic wave pulse and collide with surrounding gas. The gas ionizes like an avalanche and floating electrons are produced in the surrounding area by chains of these electron acceleration and collision with electron and gas inside plasma. These phenomena spread to the area around discharge plasma in sequence, then the surrounding area get into plasma state. In the result of the phenomena as mentioned above it, the volume of plasma increases. Then the electrons recombine rather than dissociate at the time when the electromagnetic wave pulse radiation is stopped. As a result, the electron density decreases, and the volume of plasma decreases as well. The plasma disappears when the electron recombination is completed. A large amount of OH radicals and ozone is generated from moisture in the gas mixture as a result of a large amount of the generated plasma, promoting the oxidation reaction etc. of the exhaust gas components.

In that case, oxidation reaction etc. is initiated in the combustion chamber 400 as a reactor while exhaust gas remains in the combustion chamber after the exhaust gas is produced at explosion stroke. The high temperature of the exhaust gas also promotes the oxidation reactions, which increases cleanup efficiency in combination with the oxidation reaction etc. obtained by generating a large amount of OH radicals and ozone with plasma. Therefore, it is not necessary to use a rich air-to-fuel ratio or afterburning downstream of the combustion chamber, which would prevent the mileage reduction of the internal combustion engine.

In addition, until the intake valves 510 open the intake ports 310 or the exhaust valves 520 open the exhaust ports 320 after generation exhaust gas by explosion stroke, the electromagnetic waves scattering from the combustion chamber 400 to outside is prevented. Moreover, the back face of the intake valves 510 or the exhaust valves 520 prevent some electromagnetic waves from scattering from the combustion chamber 400 to the intake port 310 or the exhaust port 320 after the intake valves 510 open the intake ports 310 or the exhaust valves 510 open the exhaust ports 320. Therefore, closed space of the combustion chamber 400 or space according to it becomes a reactor, where the oxidation reaction etc. of the exhaust gas components is stably initiated.

The after-treatment apparatus for exhaust gas in a combustion chamber of the present invention may be configured such that discharge is generated with the electrode of the discharge device and the electromagnetic waves fed from the electromagnetic wave generator through the electromagnetic wave transmission line are radiated from the antenna, while the exhaust gas remains in the combustion chamber after the exhaust gas is produced during the explosion stroke. Control method shown in FIG. 5 and explained is one example. Even though there are various embodiments, the after-treatment apparatus for exhaust gas in a combustion chamber of the second embodiment is configured such that discharge is generated with the electrode 762 of the discharge device 760 and the electromagnetic waves fed from the electromagnetic wave generator 840 through the electromagnetic wave transmission line 780 are radiated from an antenna 770, from the time when exhaust gas is produced at the explosion stroke to the time when the intake valves 510 open the intake ports 310 or the exhaust valves 520 open the exhaust ports 320, as the explanation using FIG. 4. This makes it possible that the intake valves 510 and exhaust valves 520 prevent electromagnetic waves from scattering from the combustion chamber 400 to outside. Therefore, closed space of the combustion chamber 400 becomes a reactor, where the oxidation reaction etc. of the exhaust gas components is stably initiated.

The after-treatment apparatus for exhaust gas in a combustion chamber of the present invention may be configured such that discharge is generated with the electrode of the discharge device and the electromagnetic waves fed from the electromagnetic wave generator through the electromagnetic wave transmission line are radiated from the antenna, while the exhaust gas remains in the combustion chamber after the exhaust gas is produced during the explosion stroke. This does not restrict the control method and the composition of the input-output signals of discharge device or electromagnetic wave generator. Even though there are various embodiments, the after-treatment apparatus for exhaust gas in a combustion chamber of the second embodiment comprises crank angle detector 890 and controller 880. Crank angle detector 890 detects the crank angle of crank shaft 920. Controller 880 receives the signal from this crank angle detector 890, and controls the operation of discharge device 760 and electromagnetic wave generator 840. This makes it possible that discharge at the electrode 762 and the radiation of the electromagnetic waves from the antenna 770 are controlled according to the crank angle.

The positional relationship between the antenna and the electrodes is not restricted in the after-treatment apparatus for exhaust gas in a combustion chamber of the present invention. Even though there are various embodiments, the electrode 762 is located close to a portion that the electric field intensity generated by the electromagnetic waves strengthens in the antenna 770 when the electromagnetic waves are fed into the antenna 770 in the after-treatment apparatus for exhaust gas in a combustion chamber of the second embodiment. This makes it possible that the electrical field intensity, due to the electromagnetic waves radiated from said portion of the antenna 770, is stronger than the electrical field intensity of the surrounding electromagnetic waves. Therefore, the energy of the electromagnetic wave pulse is intensively supplied to the plasma generated by discharge at the electrode 762. As a result, a large amount of OH radicals and ozone is efficiently generated, further promoting the oxidation reaction etc. of the exhaust gas components in the area centered at the electrode 762. When there are multiple areas of the antenna 770 with strong electrical field intensity, the oxidation reaction etc. of the exhaust gas components at multiple areas of the combustion chamber 400 is further promoted upon the portion approaching to the electrode 762.

In this case, the cylinder block 100 and cylinder head 300 etc. which are the major structural materials can be used without modification compared with existing internal combustion engine. All that is required are the applying of voltage to the discharge line 760 and the supply of the electromagnetic waves. Thus, it is realized to minimize the time required to design an engine E and facilitate the sharing of many parts between existing internal combustion engines.

The material of surface layers 740 on both sides of intermediate layer 730 in thickness direction is not restricted in the gasket of the internal combustion engine of the present invention. The surface layers may also be a dielectric or insulator. In the gasket of the embodiment, intermediate layer 730 is made from a dielectric, and surface layers 740 on both sides of intermediate layer 730 in thickness direction are made from a conductive material. Thus, surface layer 740 works as an earth electrode that pairs with electrode 762 of discharge line 760. The discharge is generated between electrode 762 and surface layer 740. Surface layer 740 also works as an earth conductive material that pairs with electromagnetic wave transmission line 780. The electromagnetic waves are transmitted between electromagnetic wave transmission line 780 and surface layer 740. If the intermediate layer is made from an insulator and the surface layers on both sides of the intermediate layer are made from a conductive material, the same function and effect are also gained. Moreover, if the intermediate layer is made from a dielectric or insulator and the surface layer on at least one side of the intermediate layer is made from a conductive material, the same function and effect are also gained. Additionally, the rigidity of gasket 700 improves because surface layer 740 is made from metal.

The structure and the shape of the antenna are not restricted in the gasket of the internal combustion engine of the present invention. The antenna 770 is rod-shaped as for the gasket 700 in the embodiment among such varied embodiments. The base end of the antenna 770 is installed in the intermediate layer 730 in thickness direction. A portion, to the leading end except the base end, extends along the inner peripheral edge around the opening 710 in the circumferential direction of the opening 710 in the antenna 770. This makes it possible that the electrical field intensity near the outer edge of the combustion chamber 400, generated by the electromagnetic waves radiated from the antenna 770, is stronger than the electrical field intensity in other areas of the combustion chamber 400. Therefore, the amount of OH radicals and ozone in the vicinity of the outer edge of the combustion chamber 400 is more than the amount of other areas. Oxidation reaction etc. in this area is promoted more than in other areas. Mixing of OH radicals or ozone and the air-fuel mixture is promoted by Squish Flow, Tumble or Swirl in the vicinity of the outside edge of the combustion chamber 400.

The positional relationship between the antenna and the electrode is not restricted in the gasket of the internal combustion engine of the present invention. Electrode 762 is located close to a portion of strong electrical field intensity in the antenna 770 due to the electromagnetic waves when the electromagnetic waves are fed to the antenna 770 in the embodiment among such varied embodiments. This makes it possible that the electrical field intensity, due to the electromagnetic waves radiated from said portion of the antenna 770, is stronger than the electrical field intensity of the surrounding electromagnetic waves. Therefore, the energy of the electromagnetic wave pulse is intensively supplied to the plasma generated by discharge at the electrode 762. As a result, a large amount of OH radicals and ozone is efficiently generated, further promoting oxidation reaction etc. in the area centered at the electrode 762. When there are multiple areas of the antenna 770 with strong electrical field intensity, oxidation reaction etc. at multiple areas of the combustion chamber 400 is further promoted upon the portion approaching to the electrode 762.

Other modifications of the gasket of the present invention will be described in the following paragraphs. In the description of the gasket of these other modifications, members and portions, which fulfill the same function as the gasket 700 in the second embodiment, will be applied to the same reference characters used in the second embodiment. The description of these members and portions will be omitted. And, difference points of the composition from the gasket 700 in the second embodiment will be explained about the gaskets of these other modifications. Therefore, the composition without the description is the same as the composition of the gasket 700 in the second embodiment.

Figure 11:
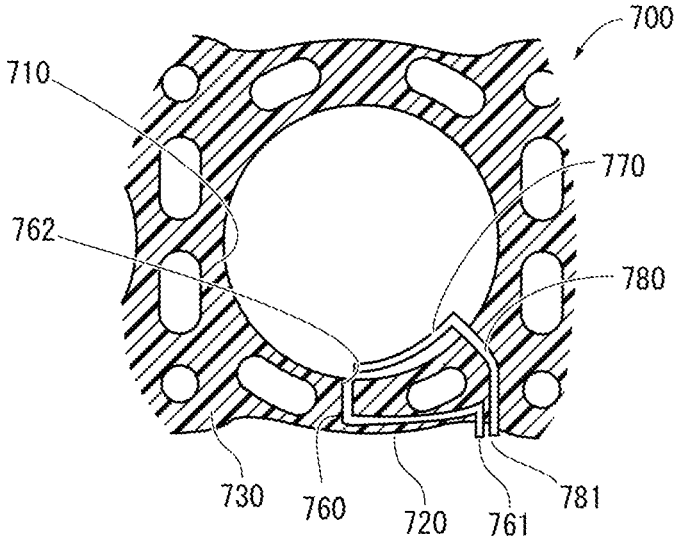
FIG. 11 shows a cross-sectional view of near one opening of the gasket, along the surface of it seen from thickness direction, used by the after-treatment apparatus for exhaust gas in the first modification of the second embodiment of the present invention.

FIG. 11 shows the first modification of gasket 700. In the second embodiment of gasket 700, the entire length of antenna 770 is almost buried in intermediate layer 730. In the first modification, the base end of antenna 770 is located in intermediate layer 730 in thickness direction; the remainder of antenna 770 extends out from intermediate layer 730 towards the center of opening 710, and then has an L-shaped curve. The end of antenna 770 is curved in an almost circular arc, and extends along the inner peripheral edge around opening 710. Because antenna 770 of the second embodiment of gasket 700 is almost buried in intermediate layer 730 for its entire length, the heat load received from combustion chamber 400 and the fatigue of antenna 770 due to machine vibration is reduced. However, because antenna 770 is exposed to combustion chamber 400 in the first modification, the electrical field intensity due to the electromagnetic waves radiated from antenna 770 becomes stronger. Other functions and effects are similar to those described for the second embodiment of gasket 700.

Figure 12:
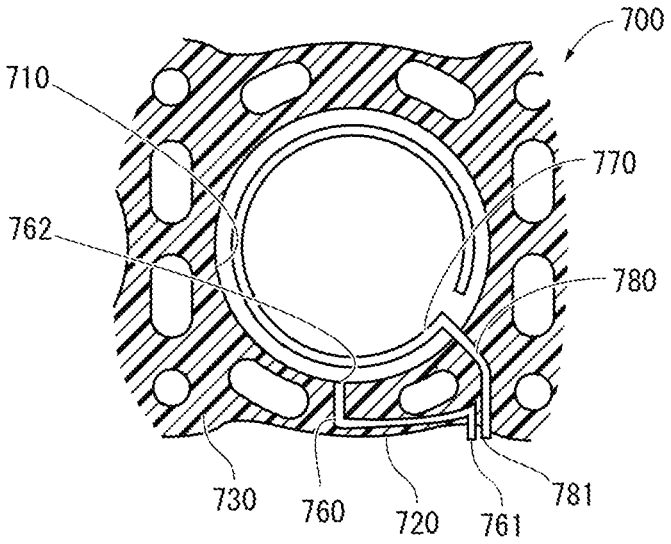
FIG. 12 shows a cross-sectional view of near one opening of the gasket, along the surface of it seen from thickness direction, used by the after-treatment apparatus for exhaust gas in the second modification of the second embodiment of the present invention.
Figure 13:
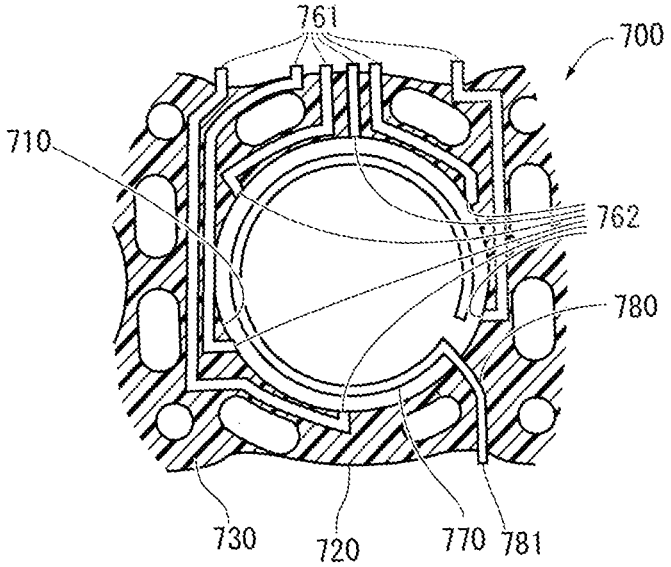
FIG. 13 shows a cross-sectional view of near one opening of the gasket, along the surface of it seen from thickness direction, used by the after-treatment apparatus for exhaust gas in the third modification of the second embodiment of the present invention.

FIG. 12 shows the second modification of gasket 700. Here, antenna 770 of this gasket 700 is longer than one in the first modification, although both gaskets are similar. The remainder of antenna 770 extends from the base end towards the center of opening 710, and then has an L-shaped curve. The end of antenna 770 is curved in an almost circular arc, and extends along the inner peripheral edge around opening 710 for one entire loop. This makes it possible to earn the length of antenna 770 and strengthen up the electrical field intensity due to the electromagnetic waves radiated from the antenna. Other functions and effects are similar to those described for the first embodiment of gasket 700. When antenna 770 becomes long like this, the standing waves are generated in the antenna 770. Therefore, two or more portions, of which the electrical field intensity due to the electromagnetic waves becomes strong in the antenna 770, can be in existence. The portions like this are more than the gasket having shorter antenna if wavelength of electromagnetic waves are same. In the third modification of gasket 700, there are two or more electrodes 762 along the inner peripheral edge, spaced equally in gasket 700, as shown in FIG. 13, though in the first modification of gasket 700 there is one electrode 762. Each Electrode 762 is located close to area with strong electrical field intensities due to the electromagnetic waves radiated by the antenna 770. This makes it possible that the electrical field intensity, due to the electromagnetic waves radiated from said portion of the antenna 770, is stronger than the electrical field intensity of the surrounding electromagnetic waves. Therefore, the energy of the electromagnetic wave pulse from said portion is intensively supplied to the plasma generated by discharge at each electrode 762. As a result, a large amount of OH radicals and ozone is efficiently generated, further promoting oxidation reaction in the area centered at the electrode 762. Oxidation reaction at multiple areas of the combustion chamber 400 is further promoted.

Figure 14:
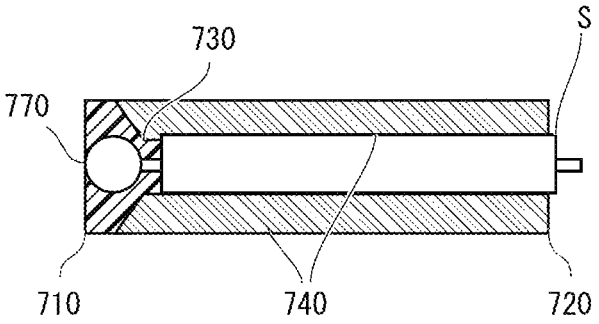
FIG. 14 shows an enlarged vertical cross-sectional view of the gasket, along the electromagnetic wave transmission line, used by the after-treatment apparatus for exhaust gas in the forth modification of the second embodiment of the present invention.

FIG. 14 shows the fourth modification of gasket 700. In the second embodiment of gasket 700, not only discharge line 760 but electromagnetic wave transmission line 780 is made from copper wire. In the fourth modification, shielded cable S is installed in intermediate layer 730 and the cable core of the inner electrical cable of shielded cable S works as a an electromagnetic wave transmission line 780. Shielded cable S comprises an inner wire, an external conductive material, and an external covering. The inner wire includes a core wire made from a conductive material such as copper, and an inner covering for the core wire made from an insulator. The external conductive material is made from a conductive material that covers the inner wire. The external covering is made from an insulator that covers the external conductive material. This makes the production of the gasket comparatively easy by using the shielded cable S. Other functions and effects are similar to those described for the second embodiment of gasket 700. Shielded cable S may be installed in intermediate layer 730, and discharge line 760 may be composed of the cable core with an inner wire of shielded cable S.

Figure 15:
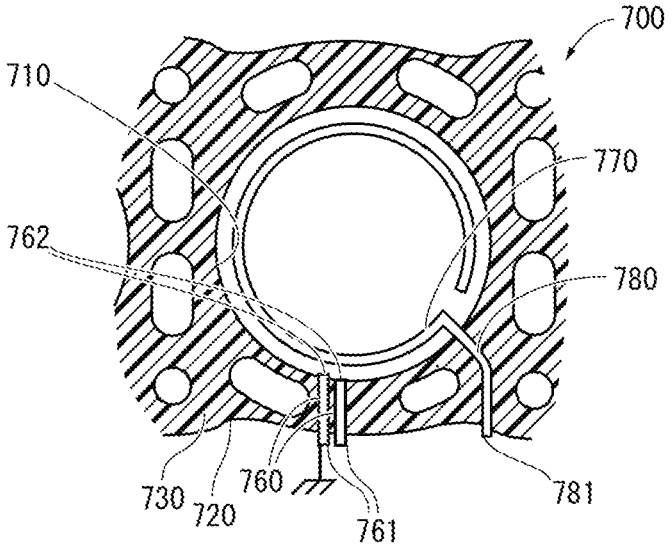
FIG. 15 shows a cross-sectional view of near one opening of the gasket, along the surface of it seen from thickness direction, used by the after-treatment apparatus for exhaust gas in the fifth modification of the second embodiment of the present invention.

FIG. 15 shows the fifth modification of gasket 700. In the second embodiment of gasket 700, discharge line 760 is installed in intermediate layer 730 in thickness direction. The anode of voltage generator 950 is connected with first connector 761 of discharge line 760. Cylinder block 100, cylinder head 300, or surface layer 740 is earthed to become an earth member. When voltage is applied between first connector 761 and said earth member, a discharge is generated between first connector 761 and the earth member. In the fifth modification, a pair of discharge lines 760 is installed in intermediate layer 730 of gasket 700. The outside edge of each discharge line 760 is exposed from outer peripheral edge 720 of gasket 700 to become first connector 761. Moreover, the inside edge of the each discharge line 760 is exposed from the outer edge of the gasket 700 towards the center of opening 710 to become electrode 762. These electrodes 762 of discharge lines 760 are arranged adjacent to each other. This makes it possible that a discharge is generated between the electrodes when voltage is applied between first connection parts of the discharge line 760. When the electrodes 762 of these discharge lines 760 are arranged adjacent to each other, a discharge can be generated using a low voltage. And the generation of OH radicals and ozone is promoted. The duration of this generated OH radicals and ozone becomes long. Power consumption is reduced. Moreover, the amount of nitrogen oxide (NOx) in the internal combustion engine is reduced because of the reduced of temperature rise in the area where discharge is generated. Other functions and effects are similar to those described for the second embodiment of gasket 700.

Next, the after-treatment apparatus for exhaust gas in third embodiment will be described. In the after-treatment apparatus for exhaust gas in third embodiment, discharge devices 810 is installed in the cylinder head 300 of the members constituting the combustion chamber 400, antenna 820 is installed on the exhaust valve 520, and electromagnetic wave transmission line 830 is installed in the cylinder head 300.

Figure 16:
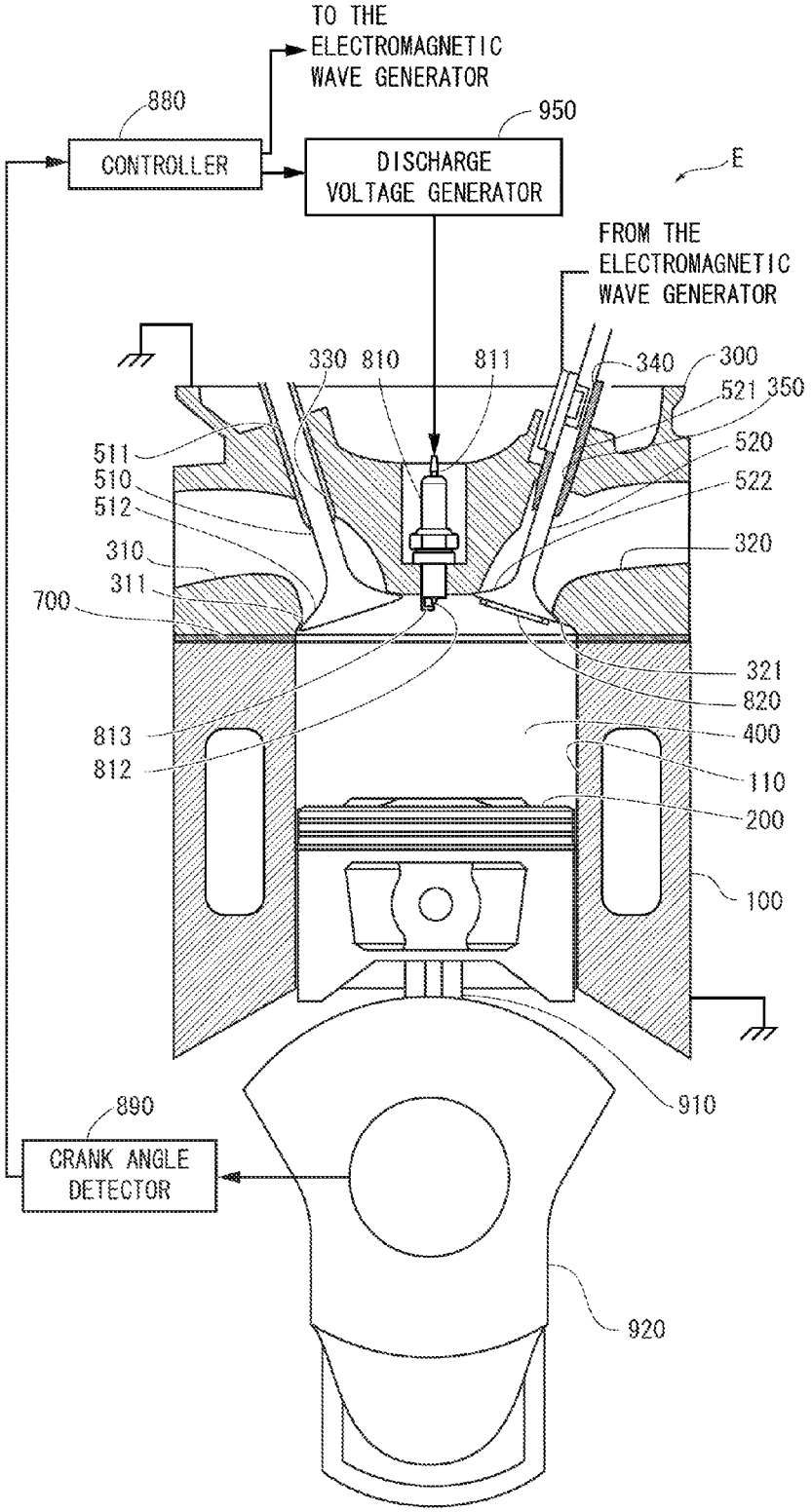
FIG. 16 shows a vertical cross-sectional view of combustion chamber in an internal combustion engine with the after-treatment apparatus for exhaust gas in the third embodiment of the present invention.

Hereinafter, the after-treatment apparatus for exhaust gas in a combustion chamber in third embodiment will be described. FIG. 16 shows the embodiment of the internal combustion engine E. The present invention targets reciprocating engines. In this embodiment, engine E is a four-cycle gasoline engine. Cylinder block 100 contains cylinder 110, which has an approximately circular cross section. Cylinder 110 penetrates cylinder block 100. Piston 200, which has an approximately circular cross section corresponding to cylinder 110, fits into cylinder 110 and reciprocates freely. Cylinder head 300 is assembled on the anti-crankcase side of cylinder block 110. Cylinder head 300, piston 200, and cylinder 110 form combustion chamber 400. Item 910 is a connecting rod, with one end connected to piston 200 and the other end connected to crankshaft 920, which is the output shaft. Cylinder head 300 has intake port 310, which is a component of the intake line, and exhaust port 320, which is a component of the exhaust line. One end of intake port 310 connects to combustion chamber 400; the other end is open at the outside wall of cylinder head 300. One end of exhaust port 320 connects to combustion chamber 400; the other end is open at the outside wall of cylinder head 300. The cylinder head has guide hole 330 that passes through intake port 310 to the outside wall of cylinder head 300. Rod-shaped valve stem 511 of intake valve 510 fits into guiding hole 330 and reciprocates freely. Umbrella-shaped valve head 512, set at the end of valve stem 511, opens and closes the combustion chamber side opening 311 of intake port 310 at a given timing by a valve open/close mechanism having a cam and so on (not shown in the figure). Cylinder head 300 has guiding hole 340 that passes through exhaust port 320 to the outside wall of cylinder head 300. Rod-shaped valve stem 521 of exhaust valve 520 fits into guiding hole 340 and reciprocates freely. Umbrella-shaped valve head 522, set at the end of valve stem 521, opens and closes the combustion chamber side opening 321 of the exhaust port 320 at a given time by the valve open/close mechanism having cam and so on (not shown in the figure). Item 810 is a spark plug installed in cylinder head 300 to expose a pair of electrodes 812, 813 to combustion chamber 400. Spark plug 810 discharges at the electrodes when piston 200 is near top dead center. Therefore, four strokes (intake, compression, combustion of mixture, and exhaust of exhaust gas) occur while piston 200 reciprocates between top dead center and bottom dead center twice. However, this embodiment does not restrict the interpretation of the internal combustion engine targeted by the present invention. The present invention is also suitable for use with two-stroke internal combustion engines and diesel engines. Target gasoline engines include direct-injection gasoline engines, which create a mixture inside the combustion chamber to inject fuel into the intake air. Target diesel engines include direct-injection diesel engines, which inject fuel into the combustion chamber directly, and divided-chamber diesel engines, which inject fuel into the divided chamber. Internal combustion engine E in this embodiment has four cylinders, but this does not restrict number of cylinders of the internal combustion engine targeted by the present invention. The internal combustion engine for this embodiment has two intake valves 510 and two exhaust valves 520, but this does not restrict the number of intake or exhaust valves of the internal combustion engine targeted by the present invention. Item 700 is a gasket installed between cylinder block 100 and cylinder head 300.

Said spark plug 810 also functions as a discharge device 810 of the after-treatment apparatus for exhaust gas of the present invention. This discharge device 810 is installed in the cylinder head 300. This discharge device 810 is set on the wall of the combustion chamber 400. This discharge device 810 comprises a connection 811 set outside of the combustion chamber 400, a first electrode 812 electrically-connected to the connection 811, and a second electrode 813 contacts the cylinder head 300 and connects in ground. The first electrode 812 and the second electrode 813 are placed opposite at specified interval on the discharge device 810. Both of them are exposed to the combustion chamber 400. The discharge device 810 is connected to a discharge voltage generator 950 which generates voltage for discharge. Here, the discharge voltage generator 950 is DC 12V power supply and a spark coil. The cylinder head 300 is earthed and the connection 811 connects to the discharge voltage generator 950. In case of applying voltage between the cylinder head 300 and the connection 811, discharge happens between the first electrode 812 and the second electrode 813. As described above, it may discharge between electrode of the discharge device and a wall of the combustion chamber, or other earthed members without a pair of electrodes. For example, in case that the internal combustion engine is a diesel engine, it does not install a spark plug under normal circumstances. Therefore it needs to install the discharge device, having an electrode exposed to the combustion chamber, on the cylinder head. In this case, it may install the spark plug as explained above as the discharge device, and connects it to the discharge voltage generator. However the discharge device does not always need to use a spark plug, because the discharge device requires generating plasma by discharge regardless the size. The discharge device may be used for example piezo element or other device.

Figure 17:
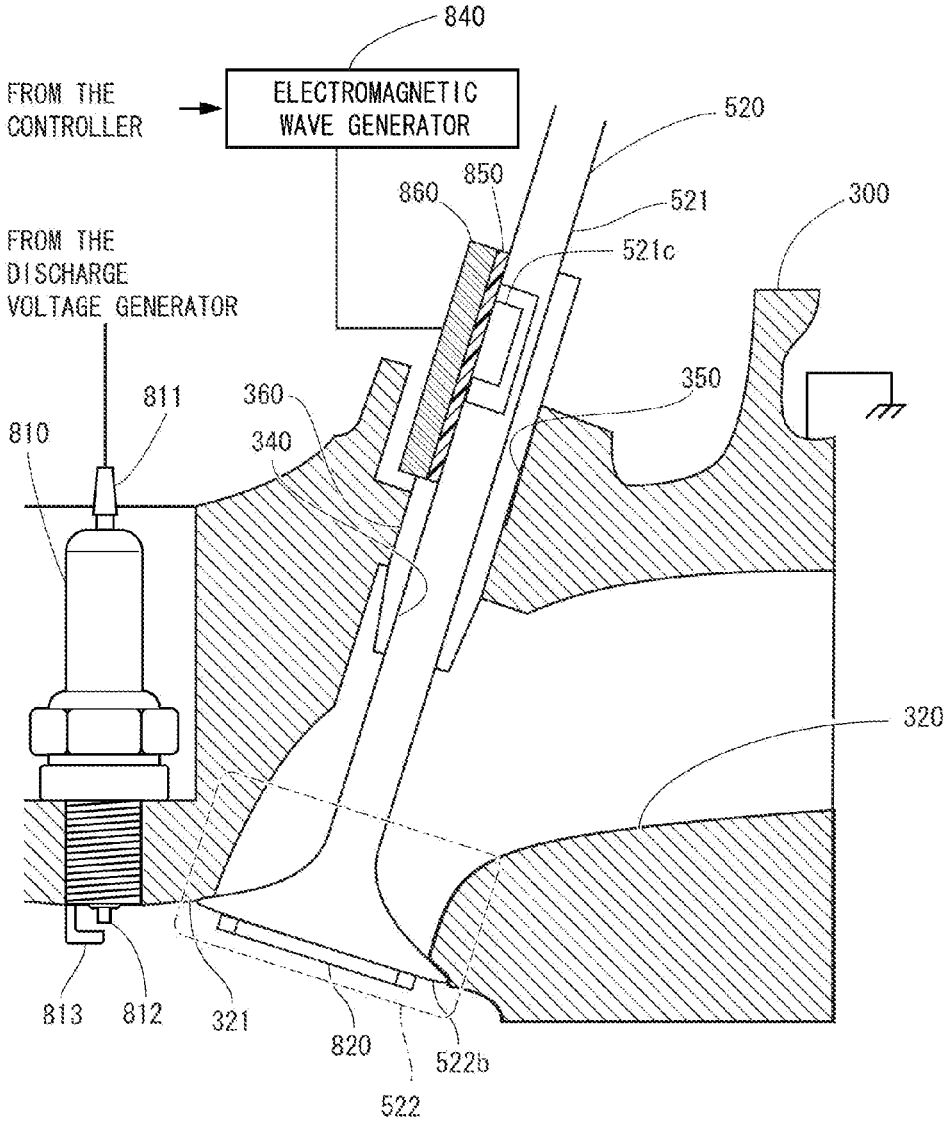
FIG. 17 shows an enlarged vertical cross-sectional view of exhaust port in an internal combustion engine with the after-treatment apparatus for exhaust gas in the third embodiment of the present invention.
Figure 19:
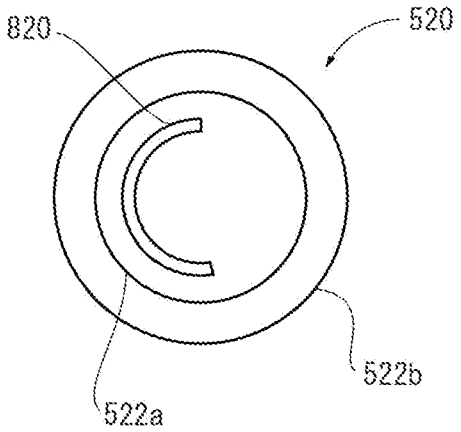
FIG. 19 shows an enlarged view of exhaust valve used by the after-treatment apparatus for exhaust gas in the third embodiment of the present invention, as seen from the valve face of the head.

An antenna 820 is installed on the valve face 522*b* of the valve head 522 of said exhaust valve 520 as shown in FIG. 17 and FIG. 19. The valve face 522*b* is a surface on opposite side against a back-face faces to the exhaust port 320 of the valve head 522. The valve face 522*b* faces the combustion chamber 400 when the combustion chamber opening 321 of the exhaust port 320 is closed with the valve head 522. The antenna 820 is made from metal. However, it can be made from a conductor, dielectric or insulator, provided that electromagnetic waves are radiated well from it to the combustion chamber when they are supplied between the antenna and the earth member. The Antenna 820 is a bar-style unit with curvature and forms nearly a C shape to surround the center of the valve face 522*b* of the valve head 522. The antenna 820 radiates electromagnetic waves to the combustion chamber 400. In fact, the antenna 820 forms nearly a C shape, in sum circularity with hiatus, to surround valve face 522*b*, as seen along the direction of valve stem 521 extending. The inside of a portion of the valve stem 521 fitting into a guide hole 340 is made from dielectric and becomes a basic portion 521*a*. A periphery side portion of this basic portion 521*a*, the portion fits into the guide hole 340, is made from metal and becomes a periphery portion 521*b*. A reason for the periphery portion 521*b* made from metal is to enhance rub resistance and burning resistance, and it can be made from other materials. Also, no fitting portions into the guide hole 340 can be made from dielectric on the valve stem 521. In addition, a successive portion to the basic portion 521*a* of said valve stem 521 is made from dielectric and becomes a basic portion 522*a* in the valve head 522. And a valve face 522*b* on the combustion chamber side of the valve head 522 is made from metal. A reason for the valve face 522*b* made from metal is to enhance burning resistance. However, it can be made from other materials. The antenna 820 is installed on the back of the basic portion 522*a* in the valve head 522. In this case, ceramic is used as dielectric. However, other dielectrics or insults can be used. For example, the length of the antenna 820 is set to a quarter of wavelength in electromagnetic waves, standing wave is generated in the antenna 820. Thus, electrical field strength at the end of antenna 820 becomes strong. For example, the length of the antenna 820 is set to a multiple of a quarter wavelengths of the electromagnetic waves so that standing waves are generated in the antenna 820, increasing the electrical field at multiple points, where the anti-nodes of the standing waves are generated, in the antenna 820. The antenna 820 can be buried in the valve head 522. In addition, the first electrode 821 and the second electrode 813 are located close to a portion that electric field intensity, generated by the electromagnetic waves around the valve face 522*b* of the valve head 522, becomes strong when the electromagnetic waves are fed to said antenna 820. In this case, the top of the antenna 820 gets close to the first current 812 and the second current 813. Therefore, upon supplying electromagnetic waves between the antenna 820 and the cylinder head 300, which is an earth member, the electromagnetic waves is radiated from the antenna 820 to the combustion chamber 400. And, one end of the antenna 820 connects to the electromagnetic wave transmission line 830, which is explained in below. In this embodiment, antenna 820 is a rod-shaped monopole antenna that is curved one. However, this does not restrict the type of antenna in the after-treatment apparatus for exhaust gas of the present invention. Therefore, antenna of the after-treatment apparatus for exhaust gas of the present invention may be dipole antenna, Yagi-Uda antenna, a single feed antenna, a loop antenna, a phase difference feed antenna. a ground-plane antenna, a anti-ground-plane type vertical antenna, a beam antenna, a horizontally polarized omni-directional antenna, a corner antenna, comb antenna, or one of the other linear antenna, a micro-strip antenna, a inverted-F antenna, or other plane antenna, slotted array antenna, a parabolic antenna, a horn antenna, a horn reflector antenna, a cassegrain antenna or other solid antennas, Beverage antenna or other progressive wave antennas, star type EH antennas, bridge type EH antennas or other EH antennas, a bar antenna, a minute loop antennas or one of the other magnetic field antennas or dielectric substance antennas.

Figure 18:
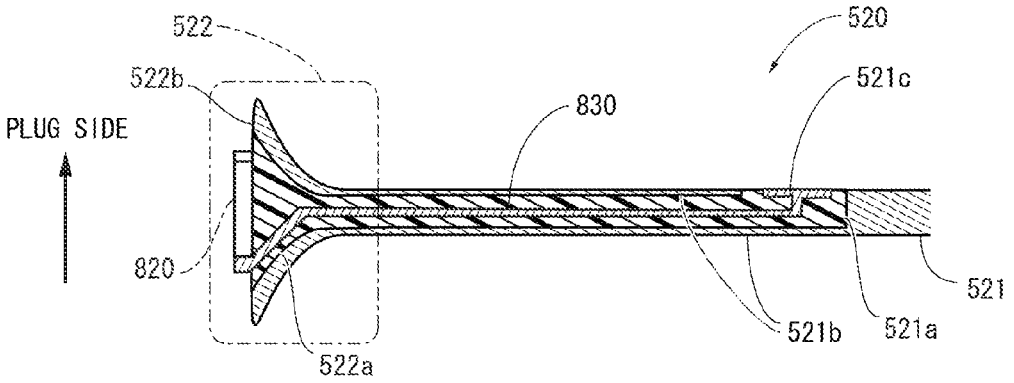
FIG. 18 shows an enlarged vertical cross-sectional view of exhaust valve used by the after-treatment apparatus for exhaust gas in the third embodiment of the present invention.

Electromagnetic wave transmission line 830, made from copper line, is installed in valve stem 521 of exhaust valve 520, as shown in FIG. 18. This electromagnetic waves transmission line 780 is made from copper line. Electromagnetic wave transmission line 830 may also be made from any conductor, insulator, or dielectric, as long as electromagnetic waves are transmitted well to antenna 820 when they are supplied between antenna 820 and the earthed member. A possible variation is an electromagnetic wave transmission line that consists of a waveguide made from a conductor or dielectric. Power-receiving portion 521*c* is installed in a fitting portion into valve guide 340 of valve stem 521. Power-receiving portion 521*c* can be made from a conductor, dielectric, or insulator. Here, power-receiving portion 521*c* is located at the periphery of valve stem 521, but it can also be located inside it. The configuration and material of power-receiving portion 521*c* is selected according to the connection method to power-feeding member 860, as described below. Power-receiving portion 521*c* can be positioned at a location farther from the valve head in the valve head than a fitting portion into the guide hole of the valve stem. One end of electromagnetic wave transmission line 830 is connected to antenna 820. The other end, which is covered with an insulator or dielectric, extends to power-receiving portion 521*c* at a fitting portion into the guide hole 340 of valve stem 521 and connects to it. Electromagnetic wave transmission line 830 runs inside basic portion 521*a* of valve stem 521. Therefore the other end of electromagnetic wave transmission line 830 is covered with a dielectric and extends to power-receiving portion 521*c*. Whereas basic portion 521*a* is made from dielectric, the other end of the electromagnetic wave transmission line is covered with an insulator and extends to power-receiving portion. Thus, when electromagnetic waves are supplied between power-receiving portion 521*c* and the earth member such as cylinder head 300, they are introduced into antenna 820.

Electromagnetic wave generator 840, which supplies electromagnetic waves to power-receiving portion 521*c*, is installed in internal combustion engine E or its surroundings. Electromagnetic wave generator 840 generates electromagnetic waves. In this embodiment of electromagnetic wave generator 840 is a magnetron that generates 2.4-GHz-bandwidth microwaves. However, this does not restrict interpretation of composition of electromagnetic wave generator of the after-treatment apparatus for gas of the present invention.

Power-receiving portion 521*c* is exposed on the outer surface of valve stem 521 in exhaust valve 520, as shown in FIGS. 17 and 18. Dielectric member 850 and power-feeding member 860 are in Cylinder head 300. Dielectric member 850 is made from a ceramic and approaches power-receiving portion 521*c* at least when valve head 522 of exhaust valve 520 closes the exhaust port opening in the side of the combustion chamber. Dielectric member 850 must be made from a dielectric. Power-feeding member 860 is made from metal. Power-feeding member 860 is close to the dielectric member 850 opposite the valve stem of exhaust valve 520. Power-feeding member 860 must be made from conductive material. The electromagnetic wave transmission method between power-feeding member 860 and power-receiving portion 521*c* via dielectric member 850 can be either electric coupling (capacitive) or magnetic coupling (dielectric). The configuration and material of power-feeding member 860 and power-receiving portion 521*c* may be selected according to the method. For example, in the case of electric coupling, power-feeding member 860 and power-receiving portion 521*c* should be conductive plates facing each other. The power feeding member 860 and the power receiving portion 521*c* may be respectively electric antenna with predefined advantage to electromagnetic waves generated by the electromagnetic wave generator 840. In the case of magnetic coupling, power-feeding member 860 and power-receiving portion 521*c* should be conductive coils. The power feeding member 860 and the power receiving portion 521*c* may be respectively a magnetic antenna with predefined advantage to electromagnetic waves generated by the electromagnetic wave generator 840. As a result, the electromagnetic wave generator 840 provides the power feeding member 860 with electromagnetic waves when the power feeding member 860 receives an output signal of the electromagnetic wave generator 840.

As shown in FIG. 17, guide mounted hole 350, which penetrates from the exhaust port 320 to the outer wall of cylinder head 300, is installed in the cylinder head 300. Valve guide with trunk shape made from a ceramics fits into the valve guide mounted hole 350, allowing a hole in the valve guide 360 to serve as a guide hole 340. Valve guide may be made from dielectric material. In valve guide 360, a portion approaching the power-receiving portion 521*c* at least when the valve head 522 of the exhaust valve 520 closes the combustion chamber side opening of the exhaust port 320 is the dielectric member 850.

The after-treatment apparatus for exhaust gas of the present invention is configured such that discharge is generated with the first electrode 812 and second electrode 813 of the discharge device 810 and the electromagnetic waves fed from the electromagnetic wave generator 840 through the electromagnetic wave transmission line 830 are radiated from the antenna 820, while the exhaust gas remains in the combustion chamber 400 after the exhaust gas is produced during the explosion stroke. Cylinder block 100 or cylinder head 300 are earthed. The earth terminals of discharge voltage generator 950 and electromagnetic wave generator 840 are earthed. Discharge voltage generator 950 and electromagnetic wave generator 840 are controlled by controller 880, which has a CPU, memory, and storage etc, and outputs control signals after computing input signals. Crank angle detection signals are sent from crank angle detector 890 to controller 880. Therefore, controller 880 receives signals from crank angle detector 890 and controls the actuations of discharge device 810 and electromagnetic wave generator 840. However, this does not restrict the control method and the composition of the input-output signals as for the after-treatment apparatus for exhaust gas of the present invention.

In the actuation of the internal combustion engine E, discharge is generated at the electrode 812, 813 of the discharge device 810 and the electromagnetic waves fed from the electromagnetic wave generator 840 through the electromagnetic wave transmission line 830 are radiated from the antenna 820. Therefore, the plasma is generated near first electrode 812, 813. This plasma receives energy of an electromagnetic waves (electromagnetic wave pulse) supplied from the antenna 820 for a given period of time. As a result, the plasma generates a large amount of OH radicals and ozone to promote the oxidation reaction etc. of the exhaust gas components. In fact electrons near these electrodes are accelerated, fly out of the plasma area, and collide with gas such as air or the air-fuel mixture in surrounding area of said plasma. The gas in the surrounding area is ionized by these collisions and becomes plasma. Electrons also exist in the newly formed plasma. These also are accelerated by the electromagnetic wave pulse and collide with surrounding gas. The gas ionizes like an avalanche and floating electrons are produced in the surrounding area by chains of these electron acceleration and collision with electron and gas inside plasma. These phenomena spread to the area around discharge plasma in sequence, then the surrounding area get into plasma state. In the result of the phenomena as mentioned above it, the volume of plasma increases. Then the electrons recombine rather than dissociate at the time when the electromagnetic wave pulse radiation is stopped. As a result, the electron density decreases, and the volume of plasma decreases as well. The plasma disappears when the electron recombination is completed. A large amount of OH radicals and ozone is generated from moisture in the gas mixture as a result of a large amount of the generated plasma, promoting the oxidation reaction etc. of the exhaust gas components.

In this case, oxidation reaction etc. is initiated in the combustion chamber 400 as a reactor while exhaust gas remains in the combustion chamber 400 after the exhaust gas is produced at explosion stroke. The high temperature of the exhaust gas also promotes the oxidation reactions, which increases cleanup efficiency in combination with the oxidation reaction etc. obtained by generating a large amount of OH radicals and ozone with plasma. Therefore, it is not necessary to use a rich air-to-fuel ratio or afterburning downstream of the combustion chamber, which would prevent the mileage reduction of the internal combustion engine E.

In addition, until the intake valves 510 open the intake ports 310 or the exhaust valves 520 open the exhaust ports 320 after generation exhaust gas by explosion stroke, the electromagnetic waves scattering from the combustion chamber 400 to outside is prevented. Moreover, the back faces of the intake valves 510 or the exhaust valves 520 prevent some electromagnetic waves from scattering from the combustion chamber 400 to the intake port 310 or the exhaust port 320 after the intake valves 510 open the intake ports 310 or the exhaust valves 510 open the exhaust ports 320. Therefore, closed space of the combustion chamber 400 or space according to it becomes a reactor, where the oxidation reaction etc. of the exhaust gas components is stably initiated.

The after-treatment apparatus for exhaust gas in a combustion chamber of the present invention may be configured such that discharge is generated with the electrode of the discharge device and the electromagnetic waves fed from the electromagnetic wave generator through the electromagnetic wave transmission line are radiated from the antenna, while the exhaust gas remains in the combustion chamber after the exhaust gas is produced during the explosion stroke. Control method shown in FIG. 5 and explained is one example. Even though there are various embodiments, the after-treatment apparatus for exhaust gas in a combustion chamber of the second embodiment is configured such that discharge is generated with the electrode 812, 813 of the discharge device 810 and the electromagnetic waves fed from the electromagnetic wave generator 840 through the electromagnetic wave transmission line 780 are radiated from an antenna 820, from the time when exhaust gas is produced at the explosion stroke to the time when the intake valves 510 open the intake ports 310 or the exhaust valves 520 open the exhaust ports 320, as the explanation using FIG. 4. This makes it possible that the intake valves 510 and exhaust valves 520 prevent electromagnetic waves from scattering from the combustion chamber 400 to outside. Therefore, closed space of the combustion chamber 400 becomes a reactor, where the oxidation reaction etc. of the exhaust gas components is stably initiated.

The after-treatment apparatus for exhaust gas in a combustion chamber of the present invention may be configured such that discharge is generated with the electrode of the discharge device and the electromagnetic waves fed from the electromagnetic wave generator through the electromagnetic wave transmission line are radiated from the antenna, while the exhaust gas remains in the combustion chamber after the exhaust gas is produced during the explosion stroke. This does not restrict the control method and the composition of the input-output signals of discharge device or electromagnetic wave generator. Even though there are various embodiments, the after-treatment apparatus for exhaust gas in a combustion chamber of the third embodiment comprises crank angle detector 890 and controller 880. Crank angle detector 890 detects the crank angle of crank shaft 920. Controller 880 receives the signal from this crank angle detector 890, and controls the operation of discharge device 810 and electromagnetic wave generator 840. This makes it possible that discharge at the electrode 812, 813 and the radiation of the electromagnetic waves from the antenna 820 is controlled according to the crank angle.

The positional relationship between the antenna and the electrodes is not restricted in the after-treatment apparatus for exhaust gas in a combustion chamber of the present invention. Even though there are various embodiments, the electrode 812, 813 is located close to a portion that the electric field intensity generated by the electromagnetic waves strengthens in the antenna 820 when the electromagnetic waves are fed into the antenna 820 in the after-treatment apparatus for exhaust gas in a combustion chamber of the third embodiment. This makes it possible that the electrical field intensity, due to the electromagnetic waves radiated from said portion of the antenna 820, is stronger than the electrical field intensity of the surrounding electromagnetic waves. Therefore, the energy of the electromagnetic wave pulse is intensively supplied to the plasma generated by discharge at the electrode 812, 813. As a result, a large amount of OH radicals and ozone is efficiently generated, further promoting the oxidation reaction etc. of the exhaust gas components in the area centered at the electrode 812, 813. When there are multiple areas of the antenna 820 with strong electrical field intensity, the oxidation reaction etc. of the exhaust gas components at multiple areas of the combustion chamber 400 is further promoted upon the portion approaching to the electrode 812, 813.

Moreover, the cylinder block 100 etc. which are the major structural materials can be used without modification compared with existing internal combustion engine. Additionally, the exhaust valve 520, and the structure around this valve are remodeled. With the exception of internal combustion engine E which basically needs spark plug 810, it may mount a discharge device on the cylinder head in internal combustion engine E that is not necessary a spark plug 810. Therefore, it is realized to minimize the time required to design an internal combustion engine E and share many parts with existing internal combustion engines.

The configuration and structure of the antenna are not restricted for the after-treatment apparatus for exhaust gas of the present invention. Even though there are various embodiments, said antenna 820 forms nearly a C shape to surround the center of the valve face 522*b* of the valve head 522 as for the after-treatment apparatus in the third embodiment. One end of antenna 820 is connected to electromagnetic wave transmission line 830. This makes the antenna 820 compact on the valve face 522*b*.

The structure for transmitting electromagnetic waves from the electromagnetic wave generator to the electromagnetic wave transmission line is not restricted for the after-treatment apparatus for exhaust gas of the present invention. In the third embodiment of the after-treatment apparatus for exhaust gas, power-receiving portion 521*c* is exposed on the outer surface of valve stem 521 of exhaust valve 520 among such varied embodiments. The after-treatment apparatus for exhaust gas has dielectric member 850 and power-feeding member 860. Dielectric member 850 is installed in cylinder head 300 and approaches power-receiving portion 521*c* at least when valve head 522 of exhaust valve 520 closes the exhaust port 320 opening in the side of combustion chamber. Dielectric member 850 is made from dielectric material. Power-feeding member 860 is installed in cylinder head 300. Power-feeding member 860 is close to the dielectric member 850 opposite the valve stem 521. Power-feeding member 860 is made from conductive material. Power-feeding member 860 is fed electromagnetic waves from electromagnetic wave generator 840. This makes it possible to have non-contact electromagnetic wave transmission from electromagnetic wave generator 840 to electromagnetic wave transmission line 830 through power-feeding member 860, dielectric member 850, and power-receiving portion 521*c*.

The structure near the guide hole is not restricted for the after-treatment apparatus for exhaust gas of the present invention. In the third embodiment of the after-treatment apparatus for exhaust gas, a valve guide mounted hole 350, which penetrates from the exhaust port 320 to the outer wall of cylinder head 300, is installed in the cylinder head 300 among such varied embodiments. A valve guide 360 with trunk shape, made from dielectric material, fits into the valve guide mounted hole 350 allowing a hole in the valve guide 360 to serve as a guide hole. A portion of the valve guide 360, approaching the power-receiving portion 521*c* at least when the valve head 522 closes the combustion chamber side opening of the exhaust port 320, is the dielectric member. This makes it possible to have non-contact electromagnetic wave transmission from electromagnetic wave generator 840 to electromagnetic wave transmission line 830 by using heretofore known mechanism for mounting the valve guide.

The positional relationship between the antenna and the electrode is not restricted for the after-treatment apparatus for exhaust gas of the present invention. In the third embodiment of the after-treatment apparatus for exhaust gas, first electrode 812 and second electrode 813 are located close to a portion where the electric field intensity generated by the electromagnetic waves around the valve face 522*b* of the valve head 522 becomes strong when the electromagnetic waves are fed to the antenna 820. This makes it possible that the electromagnetic wave pulse irradiates the plasma generated by the discharge at first electrode 812 and second electrode 813 from the antenna near plasma. The energy is intensively supplied to said plasma. As a result, a large amount of OH radicals and ozone is efficiently generated, further promoting the oxidation reaction etc.

Figure 20:
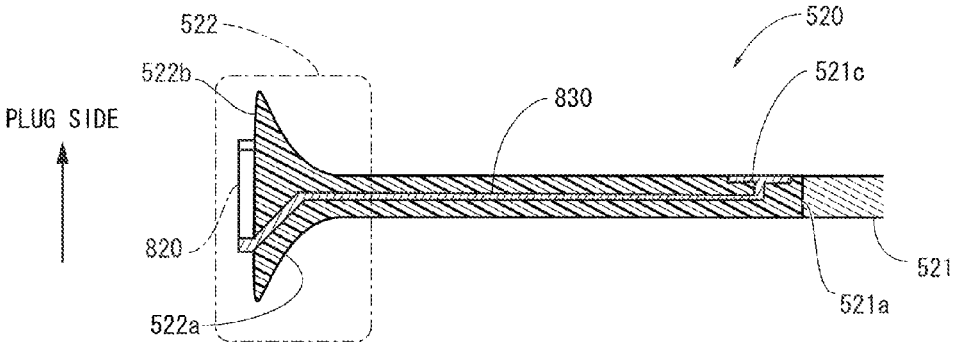
FIG. 20 shows an enlarged vertical cross-sectional view of exhaust valve used by the after-treatment apparatus for exhaust gas in the third embodiment of the present invention.

Next, the modification of the after-treatment apparatus for exhaust gas using a valve of the present invention will be described. This modification of the after-treatment apparatus for exhaust gas differs from the third embodiment only in the composition of exhaust valve 520. In the exhaust valve 520 of the plasma apparatus in the third embodiment, the interior of valve stem 521 that fits into guide hole 340 is made from a dielectric or insulator as a basic portion 521*a*. Moreover, a fitting portion into the guide hole 340 on the periphery of the basic portion 521*a* is made from metal as a periphery portion 521*b*. In the exhaust valve 520 of the modification of the after-treatment apparatus for exhaust gas, not only basic portion 521*a* but periphery portion 521*b* are an integral structure and are made from a dielectric or insulator, as shown in FIG. 20. This increases the relative volume of the dielectric or insulator for the same valve stem 521 diameter. Thus, if the impedance of electromagnetic wave transmission line 830 is same level between the third embodiments and the modification, the cross-sectional area of electromagnetic wave transmission line 830 for the second embodiment will be larger, increasing the transmitting efficiency. Other functions and effects are similar to the third embodiment of the after-treatment apparatus for exhaust gas.

In the embodiment mentioned above, the plasma apparatus is composed by using the exhaust valve. That is, these after-treatment apparatus for exhaust gas has the antenna 820 arranged on the valve face 522*b* of the valve head 522 of the exhaust valve 520. The electromagnetic wave transmission line 830 is installed in the valve stem 521 of the exhaust valve 520. The electromagnetic wave generator 840 for feeding electromagnetic waves is in the power-receiving portion 521*c* which is arranged on the valve stem 521 of the exhaust valve 520. At compression stroke when the valve head 522 of the exhaust valve 520 closes the combustion chamber side opening 321 of the exhaust port 320, this plasma apparatus configures that discharge is generated between the electrodes of the discharge device 810, and electromagnetic waves fed from the electromagnetic wave generator 840 through the electromagnetic wave transmission line 830 is radiated from the antenna 820. But the present invention includes an embodiment which the after-treatment apparatus for exhaust gas is composed by using an intake valve. That is, the after-treatment apparatus for exhaust gas using an intake valve has an antenna arranged on the valve face of the valve head of the intake valve. An electromagnetic wave transmission line is installed in the valve stem of the intake valve. The electromagnetic wave generator for feeding electromagnetic waves is installed in the power-receiving portion which is arranged on the valve stem of the intake valve. At the compression stroke when the valve head of the intake valves close the combustion chamber side openings of said intake ports, Discharge is generated between the electrodes of the discharge device 810, and electromagnetic waves fed from the electromagnetic wave generator through the electromagnetic wave transmission line are radiated from the antenna. In this case, the component of the intake valve, the antenna, the electromagnetic wave line, the power-receiving portion, the electromagnetic wave generator, the discharge device, and the electrodes of the discharge device is similar to the exhaust valve etc. of the after-treatment apparatus for exhaust gas using the exhaust valve. Functions and effects of the after-treatment apparatus for exhaust gas using the intake valve are similar to the case of said each embodiment. The antenna forms nearly a C-shaped to surround the center of the valve face. Functions and effects, in the case that one end of this antenna is connected to electromagnetic wave transmission line, are similar to the case of said each embodiment. The power-receiving portion is exposed on outer surface of said valve stem. The after-treatment apparatus for exhaust gas comprises dielectric member and power-feeding member. The dielectric member is installed in said cylinder head, and gets close to said power-receiving portion, at least when said valve head closes the combustion chamber side opening of the intake port. The dielectric member is made from dielectric. The power-feeding member is installed in the cylinder head. The power-feeding member, made from conductive, gets close to the dielectric member from the opposite side of the valve stem. Functions and effects are similar to the case of said each embodiment in the case that electromagnetic waves are supplied from the electromagnetic wave generator to the power-receiving portion. In addition, a valve guide mounted hole, which penetrates from the intake port to the outer wall of the cylinder head, in installed in the cylinder head. The valve guide with trunk shape made from a ceramics fits into the valve guide mounted hole, allowing a hole in the valve guide 360 to serve as a guide hole 340. Functions and effects are similar to the case of said each embodiment in the case that a portion of the valve guide, approaching said power-receiving portion at least when said valve head closes the combustion chamber side opening of the intake port, is the dielectric member. Moreover, Functions and effects are similar to the case of said each embodiment in the case that the electrodes are located close to a portion that electric field intensity, generated by the electromagnetic waves in the antenna, becomes strong when the electromagnetic waves are fed to said antenna.

Next, the after-treatment apparatus for exhaust gas in forth embodiment will be described. In the after-treatment apparatus for exhaust gas in first embodiment, discharge devices 810, antenna 820, and electromagnetic wave transmission line 830 are installed in the cylinder head 300 of the members constituting the combustion chamber 400.

Figure 21:
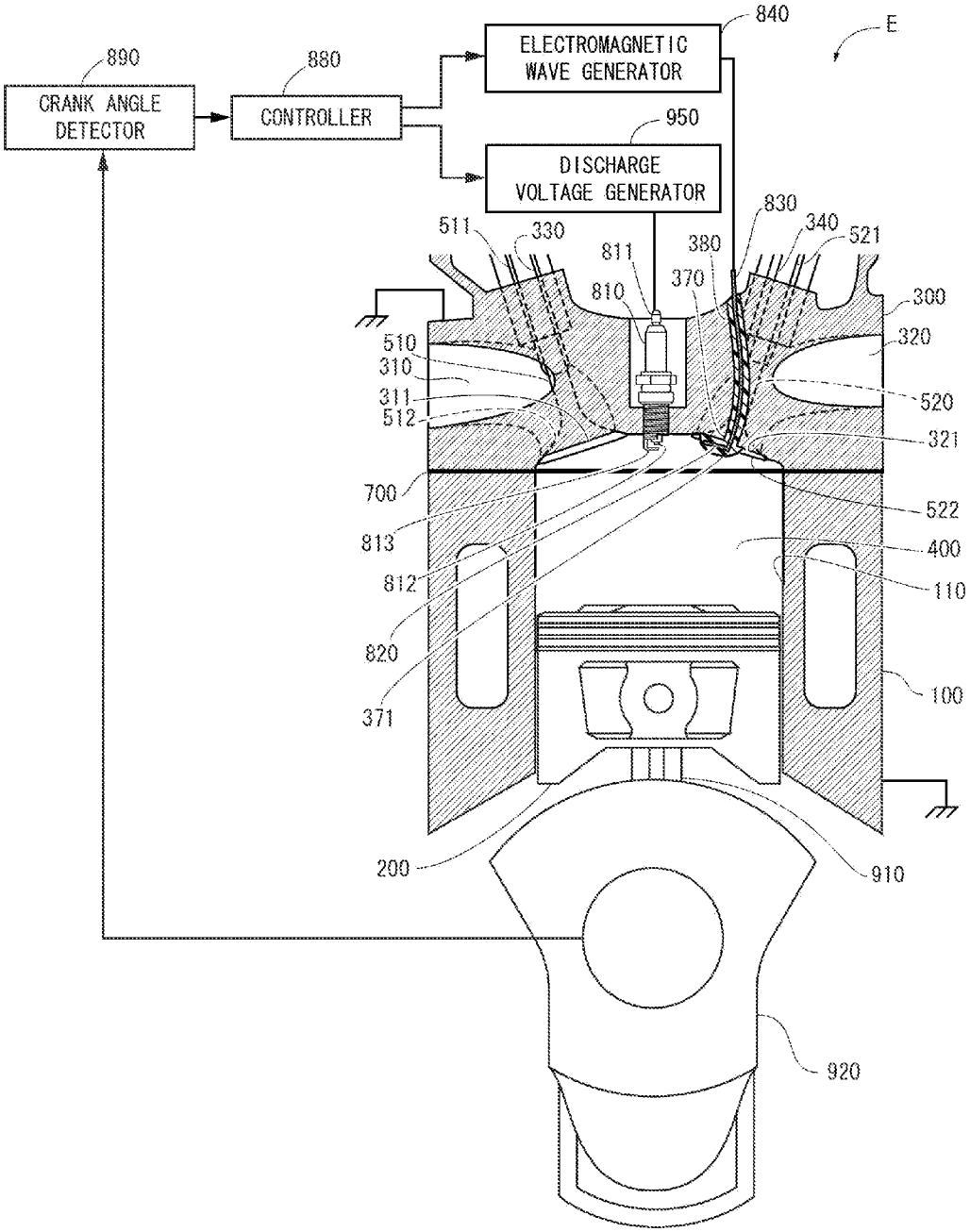
FIG. 21 shows a vertical cross-sectional view of combustion chamber in an internal combustion engine with the after-treatment apparatus for exhaust gas in the forth embodiment of the present invention.
Figure 22:
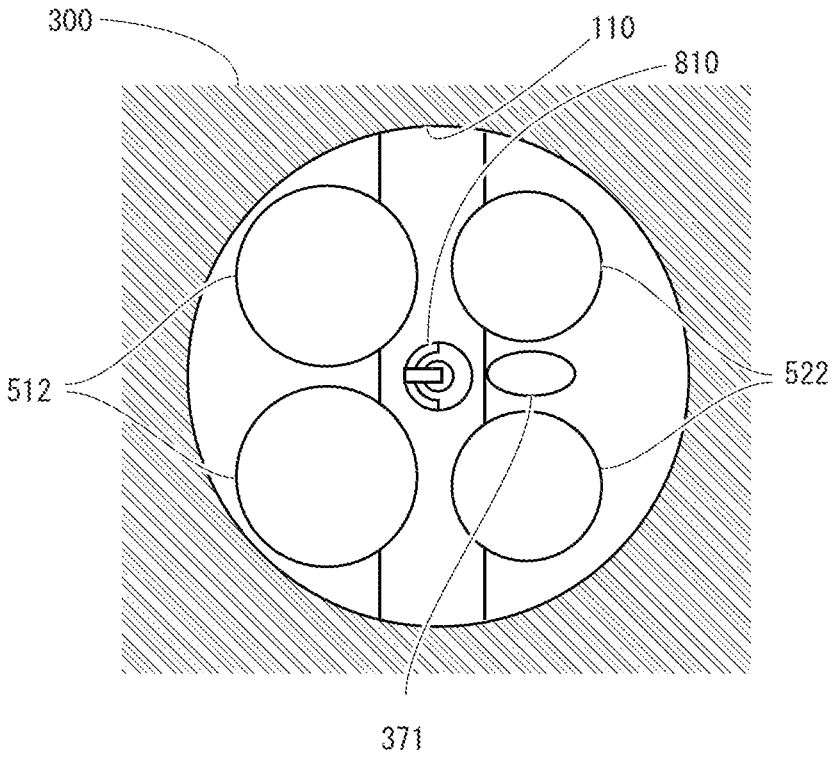
FIG. 22 shows an enlarged cross-section view of the cylinder block, along a surface seen from the direction of reciprocation of piston, in an internal combustion engine with the after-treatment apparatus for exhaust gas in the forth embodiment of the present invention.

Hereinafter, the after-treatment apparatus for exhaust gas in a combustion chamber in forth embodiment will be described. FIGS. 21 and 22 shows the embodiment of the internal combustion engine E. The present invention targets reciprocating engines. In this embodiment, engine E is a four-cycle gasoline engine. Item 100 is the cylinder block. Cylinder block 100 contains cylinder 110, which has an approximately circular cross section. Cylinder 110 penetrates cylinder block 100. Piston 200, which has an approximately circular cross section corresponding to cylinder 110, fits into cylinder 110 and reciprocates freely. Cylinder head 300 is assembled on the anti-crankcase side of cylinder block 110. Cylinder head 300, piston 200, and cylinder 110 form combustion chamber 400. Item 910 is a connecting rod, with one end connected to piston 200 and the other end connected to crankshaft 920, which is the output shaft. Cylinder head 300 has intake port 310, which is a component of the intake line, and exhaust port 320, which is a component of the exhaust line. One end of intake port 310 connects to combustion chamber 400; the other end is open at the outside wall of cylinder head 300. One end of exhaust port 320 connects to combustion chamber 400; the other end is open at the outside wall of cylinder head 300. The cylinder head has guide hole 330 that passes through intake port 310 to the outside wall of cylinder head 300. Rod-shaped valve stem 511 of intake valve 510 fits into guiding hole 330 and reciprocates freely. Umbrella-shaped valve head 512, set at the end of valve stem 511, opens and closes the combustion chamber side opening 311 of intake port 310 at a given timing by a valve open/close mechanism having a cam and so on (not shown in the figure). Cylinder head 300 has guiding hole 340 that passes through exhaust port 320 to the outside wall of cylinder head 300. Rod-shaped valve stem 521 of exhaust valve 520 fits into guiding hole 340 and reciprocates freely. Umbrella-shaped valve head 522, set at the end of valve stem 521, opens and closes the combustion chamber side opening 321 of the exhaust port 320 at a given time by the valve open/close mechanism having cam and so on (not shown in the figure). Item 810 is a spark plug installed in cylinder head 300 to expose a pair of electrodes 812, 813 to combustion chamber 400. Spark plug 810 discharges at the electrodes when piston 200 is near top dead center. Therefore, four strokes (intake, compression, combustion of mixture, and exhaust of exhaust gas) occur while piston 200 reciprocates between top dead center and bottom dead center twice. However, this embodiment does not restrict the interpretation of the internal combustion engine targeted by the present invention. The present invention is also suitable for use with two-stroke internal combustion engines and diesel engines. Target gasoline engines include direct-injection gasoline engines, which create a mixture inside the combustion chamber to inject fuel into the intake air. Target diesel engines include direct-injection diesel engines, which inject fuel into the combustion chamber directly, and divided-chamber diesel engines, which inject fuel into divided chamber. Internal combustion engine E in this embodiment has four cylinders, but this does not restrict number of cylinders of the internal combustion engine targeted by the present invention. The internal combustion engine for this embodiment has two intake valves 510 and two exhaust valves 520, but this does not restrict the number of intake or exhaust valves of the internal combustion engine targeted by the present invention. Item 700 is a gasket installed between cylinder block 100 and cylinder head 300.

Said spark plug 810 also functions as a discharge device 810 of the after-treatment apparatus for exhaust gas of the present invention. This discharge device 810 is installed in the cylinder head 300. This discharge device 810 is set on the wall of the combustion chamber 400. This discharge device 810 comprises a connection 811 set outside of the combustion chamber 400, a first electrode 812 electrically-connected to the connection 811, and a second electrode 813 contacts the cylinder head 300 and connects in ground. The first electrode 812 and the second electrode 813 are placed opposite at specified interval on the discharge device 810. Both of them are exposed to the combustion chamber 400. The discharge device 810 is connected to a discharge voltage generator 950 which generates voltage for discharge. Here, the discharge voltage generator 950 is DC 12V power supply and a spark coil. The cylinder head 300 is earthed and the connection 811 connects to the discharge voltage generator 950. In case of applying voltage between the cylinder head 300 and the connection 811, discharge happens between the first electrode 812 and the second electrode 813. As described above, it may discharge between the electrodes of the discharge device and a wall of the combustion chamber, or other earthed members without a pair of electrodes. For example, in case that the internal combustion engine is a diesel engine, it does not install a spark plug under normal circumstances. Therefore it needs to install the discharge device, having an electrode exposed to the combustion chamber, on the cylinder head. In this case, it may install the spark plug as explained above as the discharge device, and connects it to the discharge voltage generator. However the discharge device does not always need to use a spark plug, because the discharge device requires generating plasma by discharge regardless the size. The discharge device may be used for example piezo element or other device.

Antenna 820 is installed in cylinder head 300 to radiate electromagnetic waves to combustion chamber 400. The wall of combustion chamber 400 in cylinder head 300 contains a hole that penetrates to the outside wall. Inside support 370 is installed near the combustion chamber side opening of this hole, and tubular outside support 380 is installed outside and continuation of the inside support 370. Inside support 370 and outside support 380 are made from a ceramic. Both supports may be made from dielectric material or an insulator. Antenna 820, which is made from metal, is installed in inside support 370. However, it can be made from a conductor, dielectric or insulator, provided that electromagnetic waves are radiated well from it to the combustion chamber when they are supplied between the antenna and the earth member. Antenna 820 consists of a bar installed near the combustion chamber side opening of said hole. Antenna 820 protrudes from cylinder head 300 to combustion chamber 400. Inside support 370 contains a bulging portion 371. This bulging portion 371 bulges from the wall of combustion chamber 400 in cylinder head 300, covering antenna 820. Bulging portion 371 may be made from an insulator or dielectric. Because the bulging portion 371 forms part of inside support 370, it is also made from a ceramic. The bulging portion may be made from different materials against inside support. For example, the length of the antenna 820 is set to a quarter of wavelength in electromagnetic waves, standing wave is generated in the antenna 820. Thus, electrical field strength at the end of antenna 820 becomes strong. For example, the length of the antenna 820 is set to a multiple of a quarter wavelengths of the electromagnetic waves so that standing waves are generated in the antenna 820, increasing the electrical field at multiple points, where the anti-nodes of the standing waves are generated, in the antenna 820. Here, antenna 820 is buried inside support 370. The solid cross-section of antenna 820 is approximately circular for its entire length. However, antenna 820 of the after-treatment apparatus of the present invention is not restricted to a circular cross-sectional shape. The first electrode 812 and the second electrode 813 are located close to a portion where the electric field intensity generated by the electromagnetic waves becomes strong in the antenna 820 when the electromagnetic waves are fed to the antenna 820. Here, the end of antenna 820, the first electrode 812 and the second electrode 813 are close to each other along the wall of combustion chamber 400 in cylinder head 300 at specified intervals. Thus, when electromagnetic waves are supplied between antenna 820 and cylinder head 300, which is earthed, electromagnetic waves are radiated from antenna 820 to combustion chamber 400. In this embodiment, antenna 820 is a rod-shaped curved monopole. However, the antenna of the after-treatment apparatus for exhaust gas in the present invention is not restricted. The antenna of the after-treatment apparatus for exhaust gas in the present invention may be dipole type, Yagi-Uda type, single wire type, loop type, phase difference feeder type, grounded type, ungrounded and perpendicular type, beam type, horizontal polarized omni-directional type, corner-reflector type, comb type or other type of linear antenna, microstrip type, planar inverted F type or other type of flat antenna, slot type, parabola type, horn type, horn reflector type, Cassegrain type or other type of solid antenna, Beverage type or other type of traveling-wave antenna, star EH type, bridge EH type or other type of EH antennas, bar type, small loop type or other type of magnetic antenna, or dielectric antenna.

Electromagnetic wave transmission line 830 is installed in cylinder head 300. One end of electromagnetic wave transmission line 830 is connected to antenna 820, and the other end is covered by a dielectric that penetrates and stretches to the outside wall of cylinder head 300. Electromagnetic wave transmission line 830 is installed in outside support 380, and is made from copper wire. Electromagnetic wave transmission line 830 may also be made from any conductor, insulator, or dielectric, as long as electromagnetic waves are transmitted well to antenna 820 when they are supplied between antenna 820 and the earthed member. A possible variation is an electromagnetic wave transmission line that consists of a waveguide made from a conductor or dielectric. Here, electromagnetic wave transmission line 830 is buried in outside support 380, and passed through outside support 380. One end of the electromagnetic wave transmission line 830 is connected to said antenna 820 and the other end is extracted from the outside wall of cylinder head 300 to outside. Thus, when electromagnetic waves are supplied between electromagnetic wave transmission line 830 and cylinder head 300 that is the earth member, they are introduced into antenna 820.

Electromagnetic wave generator 840, which supplies electromagnetic waves to electromagnetic wave transmission line 830, is installed in internal combustion engine E or its surroundings. Electromagnetic wave generator 840 generates electromagnetic waves. In this embodiment of electromagnetic wave generator 840 is a magnetron that generates 2.45-GHz-bandwidth microwaves. However, this does not restrict interpretation of composition of electromagnetic wave generator of the after-treatment apparatus for gas of the present invention.

As shown in FIG. 21, antenna 820 stretches from the outside wall of cylinder head 300 to combustion chamber 400 along the pass of hole. Then the antenna 820 turns off L-shaped. The end of antenna 820 aims at the first electrode 812 and the second electrode 813 of discharge device 810 along the wall of combustion chamber 400 in cylinder head 300. In addition, as shown in FIG. 22, the first electrode 812 and the second electrode 813 are placed in the vicinity of the center of the combustion chamber 400, when viewed from the direction of reciprocation of the piston. Antenna 820 is installed from the first electrode 812 or the second electrode 813 to a portion corresponding to a cylinder wall on the cylinder head. Two exhaust valves 520 are installed in this embodiment, although multiple exhaust values 520 may be used. The first electrode 812, the second electrode 813, and antenna 820 are arranged so that a virtual line, which connects the first electrode 812 or the second electrode 813 and the antenna 820, pass through two adjoining ports of two inlet ports 310 and two exhaust ports 320 in the cylinder head 300.

The after-treatment apparatus for exhaust gas in a combustion chamber of the present invention may be configured such that discharge is generated with the first electrode 812 and second electrode 813 of the discharge device 810 and the electromagnetic waves fed from the electromagnetic wave generator through the electromagnetic wave transmission line 830 are radiated from the antenna 820, while the exhaust gas remains in the combustion chamber after the exhaust gas is produced during the explosion stroke. Cylinder head 300 is earthed. The earth terminals of discharge voltage generator 950 and electromagnetic wave generator 840 are earthed. Discharge voltage generator 950 and electromagnetic wave generator 840 are controlled by controller 880, which has a CPU, memory, and storage etc, and outputs control signals after computing input signals. A signal line from crank angle detector 890 for detecting crank angle of crankshaft 920 is connected to control unit 880. Crank angle detection signals are sent from crank angle detector 890 to controller 880. Therefore, controller 880 receives signals from crank angle detector 890 and controls the actuations of discharge device 810 and electromagnetic wave generator 840. However, this does not restrict the control method and the composition of the input-output signals as for after-treatment apparatus for exhaust gas of the present invention.

Therefore, at the actuation of the internal combustion engine E, discharge is generated between the electrode 812, 813 of said discharge device 810 and the electromagnetic waves fed from the electromagnetic wave generator 840 through the electromagnetic wave transmission line 830 are radiated from the antenna 820. Therefore, plasma is generated near the electrode 812, 813 by discharge. This plasma receives energy of an electromagnetic waves (electromagnetic wave pulse) supplied from the antenna 820 for a given period of time. As a result, the plasma generates a large amount of OH radicals and ozone to promote the oxidation reaction etc. of the exhaust gas components. In fact electrons near the electrode are accelerated, fly out of the plasma area, and collide with gas such as air or the air-fuel mixture in surrounding area of said plasma. The gas in the surrounding area is ionized by these collisions and becomes plasma. Electrons also exist in the newly formed plasma. These also are accelerated by the electromagnetic wave pulse and collide with surrounding gas. The gas ionizes like an avalanche and floating electrons are produced in the surrounding area by chains of these electron acceleration and collision with electron and gas inside plasma. These phenomena spread to the area around discharge plasma in sequence, then the surrounding area get into plasma state. In the result of the phenomena as mentioned above it, the volume of plasma increases. Then the electrons recombine rather than dissociate at the time when the electromagnetic wave pulse radiation is stopped. As a result, the electron density decreases, and the volume of plasma decreases as well. The plasma disappears when the electron recombination is completed. A large amount of OH radicals and ozone is generated from moisture in the gas mixture as a result of a large amount of the generated plasma, promoting the oxidation reaction etc. of the exhaust gas components.

In this case, oxidation reaction etc. is initiated in the combustion chamber as a reactor while exhaust gas remains in the combustion chamber after the exhaust gas is produced at explosion stroke. The high temperature of the exhaust gas also promotes the oxidation reactions, which increases cleanup efficiency in combination with the oxidation reaction etc. obtained by generating a large amount of OH radicals and ozone with plasma. Therefore, it is not necessary to use a rich air-to-fuel ratio or afterburning downstream of the combustion chamber, which would prevent the mileage reduction of the internal combustion engine.

In addition, until the intake valves 510 open the intake ports 310 or the exhaust valves 520 open the exhaust ports 320 after generation exhaust gas by explosion stroke, the electromagnetic waves scattering from the combustion chamber 400 to outside is prevented. Moreover, the back faces of the intake valves 510 or the exhaust valves 520 prevent some electromagnetic waves from scattering from the combustion chamber 400 to the intake port 310 or the exhaust port 320 after the intake valves 510 open the intake ports 310 or the exhaust valves 510 open the exhaust ports 320. Therefore, closed space of the combustion chamber 400 or space according to it becomes a reactor, where the oxidation reaction etc. of the exhaust gas components is stably initiated.

The after-treatment apparatus for exhaust gas in a combustion chamber of the present invention may be configured such that discharge is generated with the electrode of the discharge device and the electromagnetic waves fed from the electromagnetic wave generator through the electromagnetic wave transmission line are radiated from the antenna, while the exhaust gas remains in the combustion chamber after the exhaust gas is produced during the explosion stroke. Control method shown in FIG. 5 and explained is one example. Even though there are various embodiments, the after-treatment apparatus for exhaust gas in a combustion chamber of the first embodiment is configured such that discharge is generated with the electrode 812, 812 of the discharge device 810 and the electromagnetic waves fed from the electromagnetic wave generator 840 through the electromagnetic wave transmission line 830 are radiated from an antenna 820, from the time when exhaust gas is produced at the explosion stroke to the time when the intake valves 510 open the intake ports 310 or the exhaust valves 520 open the exhaust ports 320, as the explanation using FIG. 4. This makes it possible that the intake valves 510 and exhaust valves 520 prevent electromagnetic waves from scattering from the combustion chamber 400 to outside. Therefore, closed space of the combustion chamber 400 becomes a reactor, where the oxidation reaction etc. of the exhaust gas components is stably initiated.

The after-treatment apparatus for exhaust gas in a combustion chamber of the present invention may be configured such that discharge is generated with the electrode of the discharge device and the electromagnetic waves fed from the electromagnetic wave generator through the electromagnetic wave transmission line are radiated from the antenna, while the exhaust gas remains in the combustion chamber after the exhaust gas is produced during the explosion stroke. This does not restrict the control method and the composition of the input-output signals of discharge device or electromagnetic wave generator. Even though there are various embodiments, the after-treatment apparatus for exhaust gas in a combustion chamber of the first embodiment comprises crank angle detector 890 and controller 880. Crank angle detector 890 detects the crank angle of crank shaft 920. Controller 880 receives the signal from this crank angle detector 890, and controls the operation of discharge device 810 and electromagnetic wave generator 840. This makes it possible that discharge at the electrode 812, 813 and the radiation of the electromagnetic waves from the antenna 820 is controlled according to the crank angle.

The positional relationship between the antenna and the electrodes is not restricted in the after-treatment apparatus for exhaust gas in a combustion chamber of the present invention. Even though there are various embodiments, the electrode 812, 813 is located close to a portion that the electric field intensity generated by the electromagnetic waves strengthens in the antenna 820 when the electromagnetic waves are fed into the antenna 820 in the after-treatment apparatus for exhaust gas in a combustion chamber of the first embodiment. This makes it possible that the electrical field intensity, due to the electromagnetic waves radiated from said portion of the antenna 820, is stronger than the electrical field intensity of the surrounding electromagnetic waves. Therefore, the energy of the electromagnetic wave pulse is intensively supplied to the plasma generated by discharge at the electrode 812, 813. As a result, a large amount of OH radicals and ozone is efficiently generated, further promoting the oxidation reaction etc. of the exhaust gas components in the area centered at the electrode 812, 813. When there are multiple areas of the antenna 820 with strong electrical field intensity, the oxidation reaction etc. of the exhaust gas components at multiple areas of the combustion chamber 400 is further promoted upon the portion approaching to the electrode 812, 813.

In this case, the cylinder block etc. which are the major structural materials can be used without modification compared with existing internal combustion engine. And the cylinder head is remodeled. With the exception of internal combustion engine E which basically needs spark plug 810, it may mount a discharge device on the cylinder head in internal combustion engine that is not necessary a spark plug. Therefore, it is realized to minimize the time required to design an internal combustion engine and share many parts with existing internal combustion engines. In addition, the bulging portion reduces the heat load which affects the antenna in the combustion chamber and the fatigue of the antenna due to mechanical vibration.

In the after-treatment apparatus for exhaust gas of the present invention, the antenna may be installed to protrude from the cylinder head into the combustion chamber. The direction of the antenna tip is not restricted. Though there are various embodiments, the tip direction of the antenna 820 aims at the first electrode 812 and the second electrode 813 of the discharge device 810 in the after-treatment apparatus for exhaust gas of the present invention. This allows the plasma generated by the discharge at the electrode to radiate electromagnetic wave pulses from the antenna 820 intensively. As a result, the plasma is supplied energy intensively, which generates a large amount of OH radicals and ozone efficiently, further promoting the oxidation reaction etc.

In the after-treatment apparatus for exhaust gas of the present invention, the electrodes of the discharge device, installed in the cylinder head, may be exposed to the combustion chamber. The position of the electrodes is not restricted. Moreover, the antenna may be installed to protrude from the cylinder head into the combustion chamber. The position of the antenna is not restricted. Though there are various embodiments, the first electrode 812 and the second electrode 813 are placed in the vicinity of the center of the combustion chamber 400 when viewed from the direction of reciprocation of the piston in the after-treatment apparatus for exhaust gas of the present invention. Said antenna 820 is installed between the first electrode 812 or the second electrode 813 and the portion corresponding to the cylinder wall. This allows the plasma generated by the discharge near the first electrode 812 and the second electrode 813 to receive energy from the electromagnetic wave pulse radiated from the antenna 820, increasing its volume. Antenna 820 is installed between the first electrode 812 or the second electrode 813 and the portion corresponding to the cylinder wall. Hence, a large amount of plasma is distributed from the first electrode 812 or the second electrode 813 to the portion corresponding to the cylinder wall, and the combustion flame is spread from the first electrode 812 or the second electrode 813 to the cylinder wall by the OH radicals and ozone generated by the plasma.

In the after-treatment apparatus for exhaust gas of the present invention, relative position of the electrodes and the antenna is not restricted. Though there are various embodiments, the first electrode 812, the second electrode 813, and antenna 820 are arranged so that a virtual line, which connects the first electrode 812 or the second electrode 813 and the antenna 820, pass through two adjoining ports of two inlet ports 310 and two exhaust ports 320 in the cylinder head 300 in the after-treatment apparatus of first embodiment. This makes possible that the antenna 820 is allocated effectively by using plane between exhaust ports 320.

In the after-treatment apparatus for exhaust gas of the present invention, the positional relationship between the antenna and the electrodes are not restricted. Though there are various embodiments, the first electrode 812 and the second electrode 813 are located close to a portion where the electric field intensity generated by the electromagnetic waves becomes strong in the antenna 820 when the electromagnetic waves are fed to the antenna 820 in the after-treatment apparatus for exhaust gas of first embodiment. This makes it possible that the electromagnetic wave pulse irradiates the plasma, generated by the discharge at the first electrode 812 and the second electrode 813, from the antenna 820 near plasma. The energy is intensively supplied to said plasma. As a result, a large amount of OH radicals and ozone is efficiently generated, further promoting the oxidation reaction etc.

Figure 23:
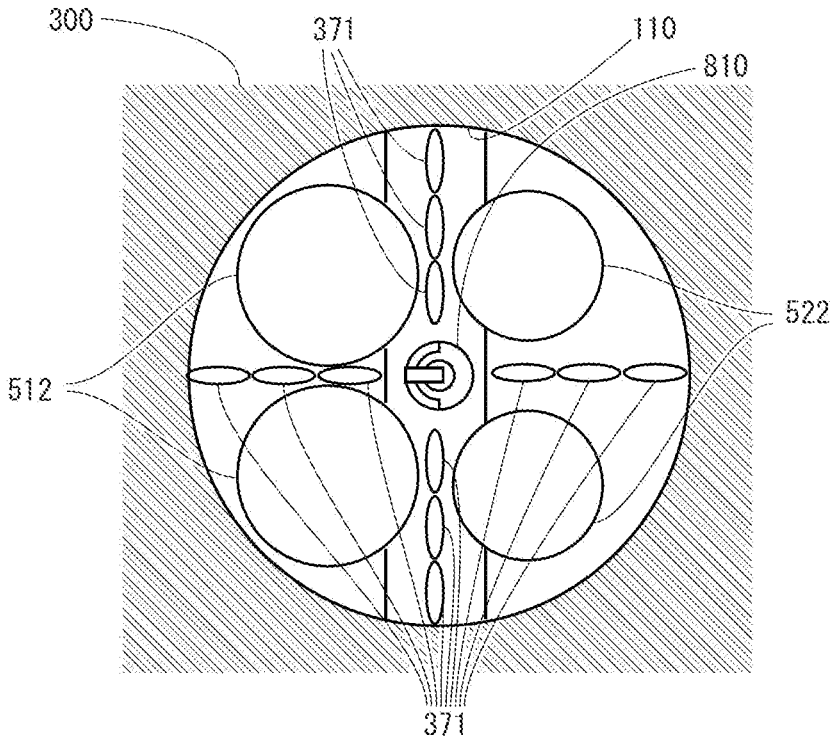
FIG. 23 shows an enlarged cross-section view of the cylinder block, along a surface seen from the direction of reciprocation of piston, in an internal combustion engine with the after-treatment apparatus for exhaust gas in the modification of the forth embodiment of the present invention.

Next, the modification of the after-treatment apparatus for exhaust gas of the present invention will be described. The modification of the after-treatment apparatus for exhaust gas is different from the fourth embodiment in only number and alignment of the antenna 820. The after-treatment apparatus for exhaust gas of the fourth embodiment installs one antenna 820. On the other hand, the modification of the after-treatment apparatus for exhaust gas, shown in FIG. 23 installs multiple antennas 820 which are same as the antenna 820 in the first embodiment. Said first electrode 812 and second electrode 813 are placed in the vicinity of the center of the combustion chamber. 400 when viewed from the direction of reciprocation of the piston 200. Moreover said multiple antennas 820 queue up from said first electrode 812 or second electrode 813 toward the portion corresponding to the cylinder wall, when viewed from the direction of reciprocation of the piston 200. Here, three antennas 820 queue up respectively along four directions radiated from the center, when viewed from the direction of reciprocation of the piston 820. The angle between two directions next to each other is almost 90 degrees. Moreover, the first electrode 812, the second electrode 813, and antennas 820 are arranged so that a virtual line, which connects the first electrode 812 or the second electrode 813 and the antenna 820, pass through two adjoining ports of two inlet ports 310 and two exhaust ports 320 in the cylinder head 300.

In the modification of the after-treatment apparatus for exhaust gas of the present invention, said first electrode 812 and second electrode 813 are placed in the vicinity of the center of the combustion chamber 400, when viewed from the direction of reciprocation of the piston. Multiple antennas queue up from the first electrode 812 or the second electrode 813 toward the portion corresponding to a cylinder wall. This allows the plasma generated by the discharge near the first electrode 812 and the second electrode 813 to receive energy from the electromagnetic wave pulse radiated from the antennas 820, increasing its volume. The antennas 820 queue up from the first electrode 812 or the second electrode 813 to the portion corresponding to the cylinder wall. Hence, a large amount of plasma is distributed from the first electrode 812 or the second electrode 813 to the portion corresponding to the cylinder wall, and the combustion flame is spread from the electrodes to the cylinder wall by the OH radicals and ozone generated by the plasma.

In the modification of the after-treatment apparatus for exhaust gas of the plasma apparatus of the present invention, the first electrode 812, the second electrode 813, and antennas 820 are arranged so that a virtual line, which connects the first electrode 812 or the second electrode 813 and the antenna 820, pass through two adjoining ports of two inlet ports 310 and two exhaust ports 320 in the cylinder head 300. This makes possible that the antennas are allocated effectively by using plane between ports. Other functions and effects are similar to the case of the plasma apparatus in the fourth embodiment of the after-treatment apparatus for exhaust gas.

In the modification of the after-treatment apparatus for exhaust gas of the present invention, a pair of the electrodes or a pair of the electrode and the earth member may as well be covered with a dielectric. In this case, the dielectric-barrier discharge is generated by voltage applied between the electrodes or between the electrode and the earth member. The dielectric-barrier discharge is restricted because charges are accumulated in the surface of the dielectric covering the electrode or the earth member. Therefore, the discharge is generated on a very small scale over a very short period of time. Thermalization does not occur in the area surrounding the discharge because the discharge is terminated after a short period of time. Therefore, the gas temperature rise due to the discharge between the electrodes is reduced, which reduces the amount of NOx produced by the internal combustion engine.

The material that installs the electromagnetic wave transmission line changes according to the material that installs the antenna, and becomes the cylinder block or a cylinder head.

The present invention includes some embodiments that combine the characteristics of the embodiments described above. Moreover, the embodiments described above are only examples of the after-treatment apparatus for exhaust gas in a combustion chamber of the present invention. Thus, the description of these embodiments does not restrict interpretation of the after-treatment apparatus for exhaust gas in a combustion chamber of the present invention.

The invention claimed is:

1. An after-treatment apparatus for exhaust gas in a combustion chamber of an internal combustion engine, comprising:

a cylinder head having an intake port and an exhaust port;

a cylinder block;

a gasket installed between the cylinder head and the cylinder block;

a spark-plug installed in the cylinder head and between the intake port and the exhaust port and configured to ignite an air-fuel mixture supplied to the combustion chamber;

a discharge device installed in the gasket and having an electrode which has one end exposed at an inner peripheral edge of the gasket to the combustion chamber;

an antenna installed in the gasket and having one end extending along the inner peripheral edge of the gasket and exposed to the combustion chamber;

an electromagnetic wave generator connected to the antenna and configured to irradiate electromagnetic waves to an inside of the combustion chamber via the antenna; and a crankshaft angle detector that detects an angle of a crankshaft, wherein the after-treatment apparatus is configured to generate a discharge to ignite the air-fuel mixture by the spark-plug at a given timing based on the crankshaft angle detected by the crankshaft angle detector, thereby producing an exhaust gas in the combustion chamber, and further configured to generate another discharge from the electrode of the discharge device and irradiate the electromagnetic waves from the antenna in the combustion chamber for a given period of time, while the exhaust gas remains in the combustion chamber during an explosion stroke based on the crankshaft angle detected by the crankshaft angle detector.

* * * * *